US012630381B2

(12) United States Patent
Tsujimura et al.

(10) Patent No.: US 12,630,381 B2
(45) Date of Patent: May 19, 2026

(54) IMAGE FORMING APPARATUS

(71) Applicant: BROTHER KOGYO KABUSHIKI KAISHA, Nagoya (JP)

(72) Inventors: Yuki Tsujimura, Konan (JP); Takashi Suzuki, Toyota (JP); Tetsuya Saso, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 62 days.

(21) Appl. No.: 18/618,284

(22) Filed: Mar. 27, 2024

(65) Prior Publication Data

US 2024/0327155 A1 Oct. 3, 2024

(30) Foreign Application Priority Data

Mar. 31, 2023 (JP) ..... 2023-058291

(51) Int. Cl.

| | |
|---|---|
| ***B41J 11/70*** | (2006.01) |
| ***B65H 5/06*** | (2006.01) |
| ***B65H 7/02*** | (2006.01) |
| ***B65H 35/08*** | (2006.01) |

(52) U.S. Cl.

CPC ... *B65H 5/062* (2013.01); *B65H 2301/51532* (2013.01); *B65H 2551/26* (2013.01); *B65H 2801/03* (2013.01)

(58) Field of Classification Search

CPC ..... B41J 11/70; B41J 11/703; B41J 11/706; B41J 11/66; G03G 15/6523; G03G 15/55; G03G 15/5016; G03G 15/5012; G03G 2215/00814; B65H 35/08; B65H 35/06; B65H 2301/515; B65H 2301/5151; B65H 7/02; B65H 7/14

See application file for complete search history.

(56) References Cited

U.S. PATENT DOCUMENTS

| | | | | |
|---|---|---|---|---|
| 9,364,964 | B2 * | 6/2016 | Watanabe | B41J 11/706 |
| 2012/0210838 | A1 * | 8/2012 | Maeyama | B26D 1/245 83/522.12 |
| 2013/0095990 | A1 * | 4/2013 | Maeyama | B26D 1/185 493/31 |
| 2021/0237492 | A1 | 8/2021 | Watari et al. | |

(Continued)

FOREIGN PATENT DOCUMENTS

| | | | |
|---|---|---|---|
| JP | 2002-326412 | A | 11/2002 |
| JP | 2011-005831 | A | 1/2011 |
| JP | 2021-155198 | A | 10/2021 |

*Primary Examiner* — Luis A Gonzalez

(74) *Attorney, Agent, or Firm* — Baker Botts L.L.P.

(57) ABSTRACT

An image forming apparatus includes: a conveyor conveying a sheet medium; an image forming part forming an image on the sheet medium; a cutting part; a signal outputting part outputting a state signal; a reporting part; and a controller. The controller executes: an image forming process of conveying the sheet medium by the conveyor and forming the image on the sheet medium by the image forming part, and a cutting process of moving the cutting part. In a case where the sheet medium has not been cut even though the cutting process was executed during image formation on the sheet medium in the image forming process, the controller continues the image formation without interruption and causes the reporting part to report information regarding a failure of cutting of the sheet medium.

16 Claims, 17 Drawing Sheets

(56) References Cited

U.S. PATENT DOCUMENTS

| | | | | |
|---|---|---|---|---|
| 2023/0191809 | A1* | 6/2023 | Yoshimune | B41J 11/663<br>347/104 |
| 2023/0202217 | A1* | 6/2023 | Ohhashi | B26D 1/185<br>347/101 |

* cited by examiner

FIG. 8

| | | | COEFFICIENT K1 | COEFFICIENT K2 |
|---|---|---|---|---|
| ROLL SHEET PRINTING | PLAIN PAPER | PREDETERMINED AMOUNT OR LESS | 1.1 | 1.0 |
| | | EXCEEDING PREDETERMINED AMOUNT | 1.05 | 1.0 |
| | GLOSSY PAPER | PREDETERMINED AMOUNT OR LESS | 1.15 | 1.05 |
| | | EXCEEDING PREDETERMINED AMOUNT | 1.1 | 1.05 |
| CUT SHEET PRINTING | PLAIN PAPER | | 1.1 | 1.0 |
| | GLOSSY PAPER | | 1.1 | 1.05 |

IMAGE FORMING APPARATUS

REFERENCE TO RELATED APPLICATIONS

This application claims priority from Japanese Patent Application No. 2023-058291 filed on Mar. 31, 2023. The entire content of the priority application is incorporated herein by reference.

BACKGROUND ART

Conventionally, there is a known printer including a conveyor which conveys a roll sheet (sheet medium) in a conveying direction, a head (image forming part) which forms an image on the roll sheet, and a cutting part which is disposed upstream of the head in the conveying direction and which is capable of cutting the roll sheet being conveyed by the conveyor.

SUMMARY

In the above-described known printer, for example, while an image forming process of forming the image on the roll sheet is being performed, a cutting operation of the roll sheet is executed at a timing at which a cutting scheduled position of the roll sheet reaches the cutting part. In this situation, in a case where the roll sheet is not cut due to any inconvenience occurring in the cutting of the roll sheet, it is conceivable, for example, that the following operation is to be executed. Namely, in such a case where a cutting failure, resulting in the roll sheet not being cut, is detected after the cutting operation of the roll sheet, a reporting operation may be performed to report, to a user, that the roll sheet is to be cut manually and to be removed. In this situation, for example, if the image forming process is in progress, the image forming process is interrupted or suspended; the roll sheet is cut by the user with scissors at an appropriate position in the roll sheet, and a part, of the roll sheet on which the image formation is being in progress and which is downstream of a cut position (a part, of the roll sheet, on which only a part of a desired image has been formed) is removed by the user. Further, the image forming process may be performed again on a part of the roll sheet, which is upstream of the cut position.

In a case where such a cutting failure of the roll sheet occurs and a sheet, which is a part of the roll sheet on which the image formation is in progress, is removed, the removed sheet and an image forming agent forming the image on the sheet are consequently consumed wastefully.

In view of the above-described situation, an object of the present disclosure is to provide an image forming apparatus capable of reducing wasteful consumption of a sheet medium and an image forming agent.

According to an aspect of the present disclosure, an image forming apparatus includes: a conveyor configured to convey a sheet medium in a conveying direction; an image forming part configured to form an image on the sheet medium being conveyed by the conveyor; a cutting part configured to be moved in a direction crossing the conveying direction; a signal outputting part configured to output a state signal indicating whether or not the sheet medium is cut; a reporting part; and a controller. The controller is configured to execute: an image forming process of conveying the sheet medium by the conveyor and forming the image on the sheet medium by the image forming part based on an image forming instruction; and a cutting process of moving the cutting part. In a case where the sheet medium has not been cut even though the cutting process was executed during image formation on the sheet medium in the image forming process, the controller is configured to continue the image formation without interruption and to cause the reporting part to report information regarding a failure of cutting of the sheet medium.

According to the image forming apparatus of the present disclosure, even though the sheet medium has not been cut despite the cutting process being executed during the image formation, the image formation is continued without being interrupted. This can reduce wasteful consumption of the sheet medium and the image forming agent. Further, the user can grasp the information regarding the failure of the cutting of the sheet medium.

BRIEF DESCRIPTION OF DRAWINGS

FIGS. 4A and 4B are each a schematic plan view of the cutting part as depicted in FIG. 1, wherein FIG. 4A is a view depicting a situation that a rotary blade and a carriage are arranged at a standby position and FIG. 4B is view depicting a situation that the rotary blade and the carriage are arranged at a stop position.

FIG. 8 is a view indicating coefficients corresponding to respective conditions and stored in a flash memory of a printer according to a modification of the present disclosure.

DESCRIPTION

A printer 1 according to an embodiment of the present disclosure will be described in the following, with reference to the drawings. In the following description, the up-down direction is defined, with a state in which the printer 1 is installed usably (a state of FIG. 1), as the reference; the front-rear direction is defined, with a side on which an opening 13 of a casing 11 is provided is defined as a front side (front surface, frontward) and with a side on which an opening 14 is provided is defined as a rear side (rear surface or rearward); and the left-right direction is defined, with the printer 1 as seen from the front side.

Figure 1:
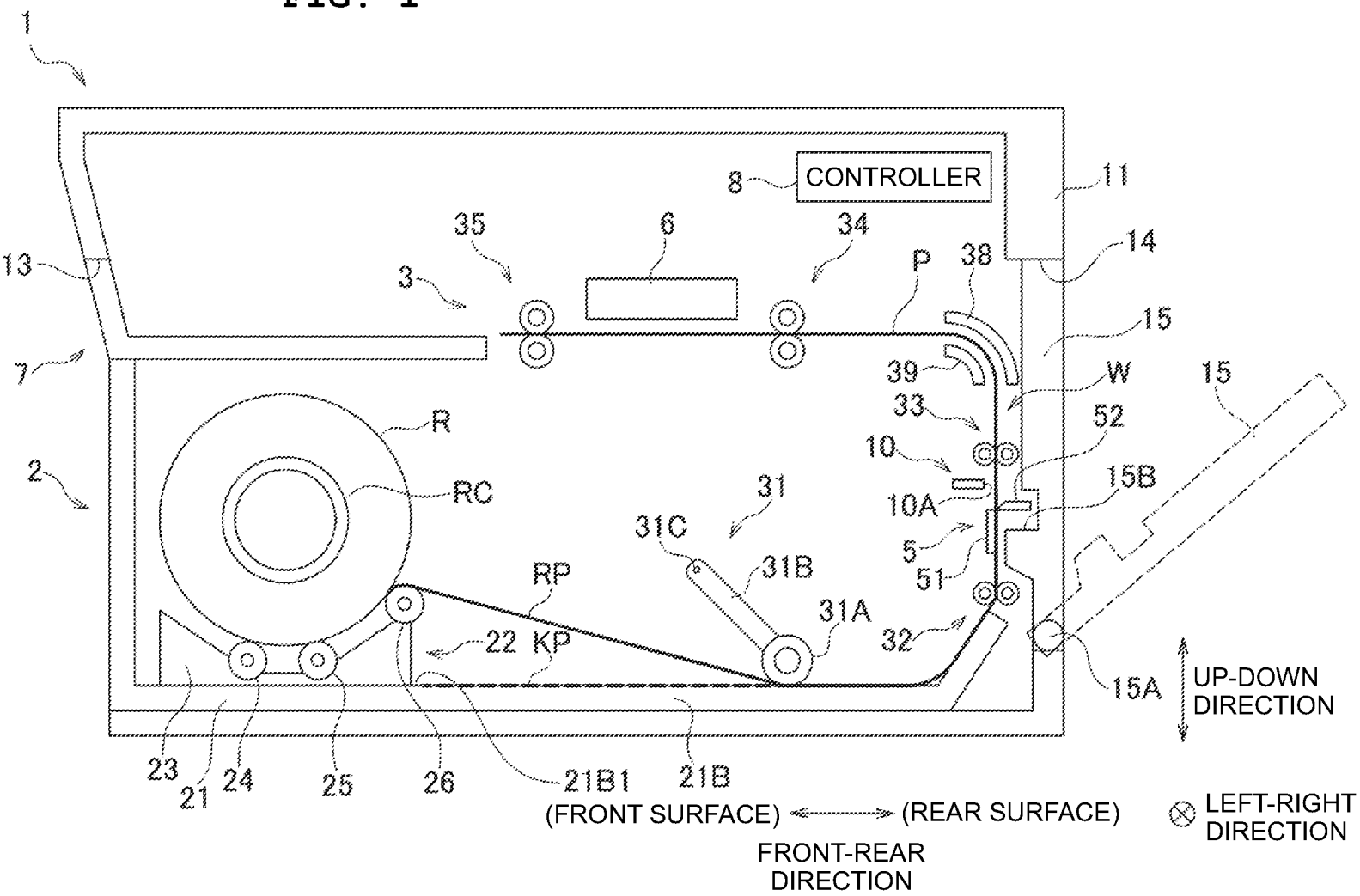
FIG. 1 is a side view depicting a schematic configuration of a printer according to an embodiment of the present disclosure.

As depicted in FIG. 1, the printer 1 (an "image forming apparatus" of the present disclosure) includes a feed cassette 2, a conveyor 3, a cutting part 5, a head 6, a discharge tray 7, a controller 8, a reporting part 9 (see FIG. 2), a sheet detecting sensor 10, the casing 11, a cover 15, a cutter sensor 16 (see FIGS. 4A and 4B), and encoders 17 and 36 (see FIG.

2). Note that an "apparatus body" of the present disclosure is constructed of the casing 11, which encloses the feed cassette 2, the conveyor 3, the head 6, the cutting part 5, the discharge tray 7, the controller 8, the reporting part 9, the sheet detecting sensor 10, the cutter sensor 16, the encoders 17 and 36, and other components. Note that the apparatus body includes at least the casing 11, the conveyor 3 and the head 6; and that other constituent parts or elements which are different from the casing 11, the conveyor 3 and the head 6 may not be included in the apparatus body.

The feed cassette 2 is arranged in the casing 11 at a location below the head 6. The discharge tray 7 is arranged in the casing 11 at a location which is in front of the head 6 and which is above the feed cassette 2. The feed cassette 2 and the discharge tray 7 are insertable along the front-rear direction into the casing 11, via the opening 13 provided on the front surface of the casing 11. Further, the feed cassette 2 mounted in the casing 11 is insertable and detachable along the front-rear direction via the opening 13. Further, the discharge tray 7 mounted in the casing 11 can be pulled frontward via the opening 13.

The feed cassette 2 stores or accommodates either one type of a sheet P of which types are a roll body R and a cut sheet KP so that either one of the roll body R and the cut sheet KP can be conveyed. In the roll body R, a long roll sheet RP (corresponding to a "sheet medium" of the present disclosure) is wound in a roll shape around an outer circumferential surface of a cylindrically shaped roll core (paper tube) RC. As depicted in FIG. 1, the feed cassette 2 has: a tray 21 having a box-like shape which is opened upward and a supporting part 22 which rotatably supports the roll body R while supporting the outer circumferential surface in a lower-side part of the roll body R. The cut sheet KP (the "sheet medium" of the present disclosure) is placed on a part, of a bottom surface 21B1 of the tray 21, which is located behind the supporting part 22, or on the entirety of the bottom surface 21B1 from which the supporting part 22 is detached. In the following description, in a case where the roll sheet RP unwound from the roll body R and the cut sheet KP are not distinguished, the roll sheet RP and the cut sheet KP are referred to a "sheet P".

The supporting part 22 has a supporting stand 23 and three rollers 24 to 26. The roll body R is supported by the supporting part 22 in a posture, of the roll body R, in which an axial direction of the roll body R is parallel to the left-right direction (a direction orthogonal to a sheet surface of FIG. 1). The supporting stand 23 is provided detachably installable with respect to the bottom part 21B of the tray 21. The supporting stand 23 extends along the left-right direction. Each of the rollers 24 to 26 is rotatably supported by the supporting stand 23 in a posture thereof in which an axial direction thereof is parallel to the left-right direction. These three rollers 24 to 26 support the roll body R from therebelow, in a state that the rollers 24 to 26 are in contact with the outer circumferential surface in the lower-side part of the roll body R.

The cover 15 is arranged at the opening 14 provided on the back surface of the casing 11. The cover 15 has a lower end part that is rotatably supported by a shaft 15A supported by the casing 11. The shaft 15A extends in the left-right direction (the direction orthogonal to the sheet surface of FIG. 1). The cover 15 rotates about the shaft 15A to be thereby allowed to be located or arranged at a closed position (a position indicate by solid lines in FIG. 1) and an open position (a position indicated by broken lines in FIG. 1). The cover 15 at the closed position defines a conveyance path W, of the sheet P, which is defined between the cover 15 and a non-illustrated guide provided in the casing 11. Further, in a case where the cover 15 is located at the open position, a part of the conveyance path W is thereby opened or released.

Figure 2:
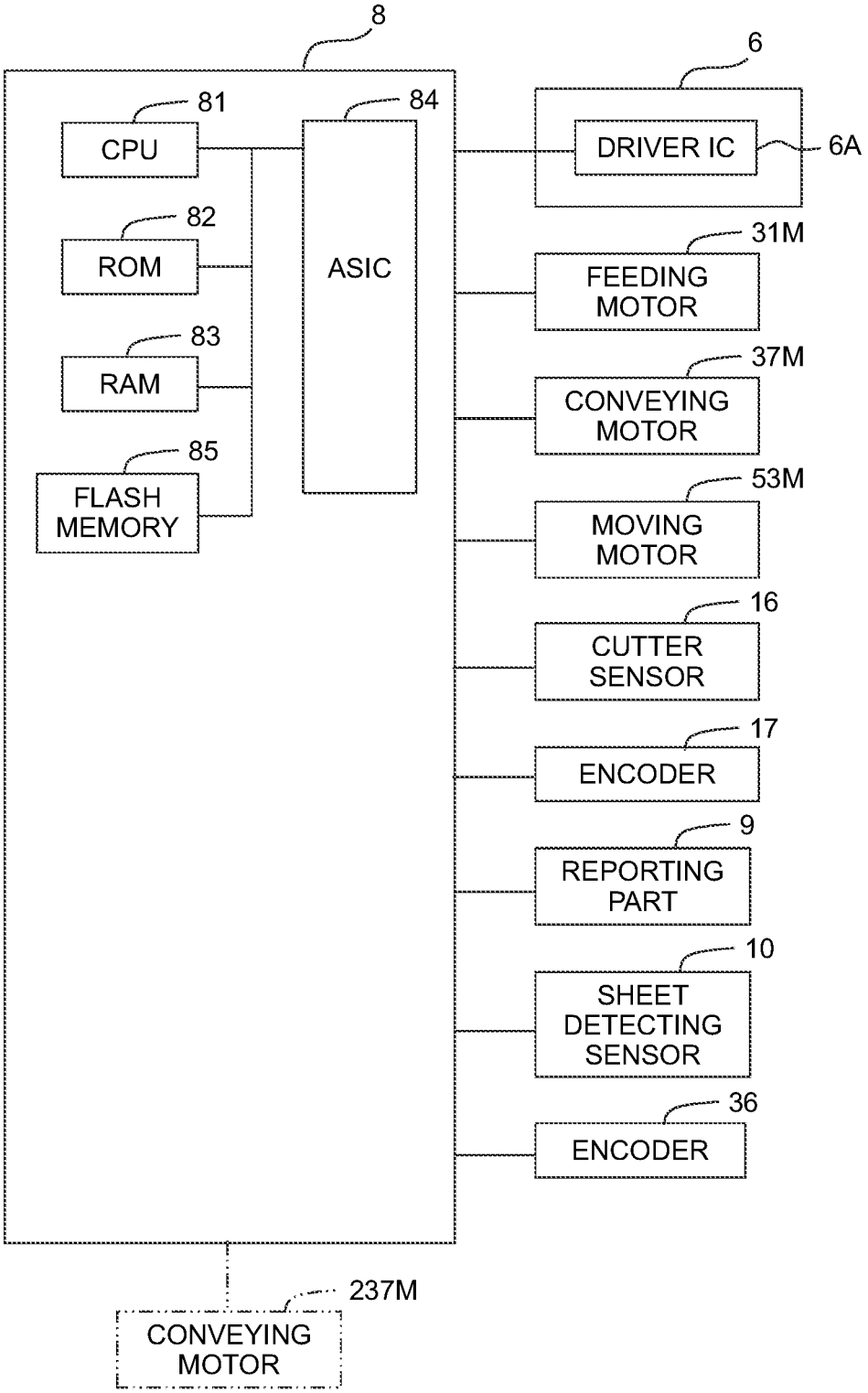
FIG. 2 is a block diagram of a controller of the printer as depicted in FIG. 1.

The conveyor 3 includes a feeding part 31, three conveying roller pairs 33 to 35 and a conveying motor 37M (see FIG. 2). The feeding part 31 feeds the sheet P, which is either one of the roll body R and the cut sheet KP accommodated in the feed cassette 2, rearward from the feed cassette 2.

The feeding part 31 is arranged at a location above the feed cassette 2, and has a feeding roller 31A, an arm 31B and a feeding motor 31M (see FIG. 2). The feeding roller 31A is pivotally supported by a forward end of the arm 31B. The arm 31B is rotatably supported by a support shaft 31C. The arm 31B is urged by a spring, etc., to a direction in which the feeding roller 31A contacts with the bottom surface 21B1 of the tray 21. Further, the arm 31B is configured to be retractable upward in a case where the tray 21 is (being) attached and detached. The feeding roller 31A is rotated by a power applied thereto from the feeding motor 31M. In a case where the feeding motor 31M is driven by a control of the controller 8, the feeding roller 31A is rotated thereby, which in turn feeds the sheet P accommodated in the tray 21 rearward.

The three conveying roller pairs 33 to 35 convey the sheet P fed by the feeding part 31 in the casing 11 along a conveying direction orthogonal to the left-right direction. The three conveying roller pairs 33 to 35 are disposed in this order from an upstream side in the conveying direction. Further, a guide roller pair 32 is disposed above a forward end of the feed cassette 2 mounted in the casing 11, as depicted in FIG. 1. The guide roller pair 32 guides the sheet P fed from the feed cassette 2 by the feeding part 31 to the guide roller pair 33. The sheet P which is (being) guided by the guide roller pair 32 is firstly fed upward, in a posture in which one surface of the sheet P faces rearward and the other surface of the sheet P faces frontward, and passes the cutting part 5.

The conveying roller pair 33 conveys, upward, the sheet P conveyed by the conveying roller pair 32. An outer guide 38 and an inner guide 39 which are configured to guide, frontward, the sheet P which is being conveyed by the conveying roller pair 33 are arranged between the conveying roller pair 33 and the conveying roller pair 34 in the conveying direction, as depicted in FIG. 1. The outer guide 38 and the inner guide 39 are arranged with a predetermined spacing distance therebetween, and the sheet P is conveyed between the outer and inner guides 38 and 39. The outer and inner guides 38 and 39 are formed so as to bent or curved further frontward, as being oriented further upward.

The conveying roller pair 34 receives the sheet P conveyed and passed between the outer guide 38 and the inner guide 39 by the conveying roller pair 33, and feeds the sheet P to the head 6. The conveying roller pair 35 receives the sheet P conveyed by the conveying roller pair 34 and discharges the sheet P. The sheet P is fed frontward by the conveying roller pairs 34 and 35.

Each of the conveying roller pairs 33 to 35 is constructed of a driving roller which rotates by a power applied thereto from the conveying motor 37M and a driven roller which rotates following the rotation of the driving roller. In a case where the conveying motor 37M is driven by a control of the controller 8, the driving roller and the driven roller of each of the conveying roller pairs 33 to 35 rotate in a state that the sheet P is nipped by the driving roller and the driven roller, thereby conveying the sheet P in the conveying direction.

The encoder 36 is configured to output a signal indicating the number of rotations (rotation rate) and an angle of the conveying motor 37M. This enables the controller 8 to derive a conveyance amount of the sheet P based on the signal from the encoder 36.

As depicted in FIG. 1, the cutting part 5 is disposed upstream of the head 6 in the conveying direction. Further, the cutting part 5 is arranged at a location above the guide roller pair 32 and between the guide roller pair 32 and the conveying roller pair 33 in the conveying direction. The cutting part 5 has a fixed blade 51, a rotary blade 52 and a moving mechanism 53 (see FIGS. 4A and 4B); the fixed blade 51 and the rotary blade 52 cooperate to cut the roll sheet RP which passes a path WX (a part of the conveyance path W; see FIG. 3) between the fixed blade 51 and the cover 15.

Figure 3:
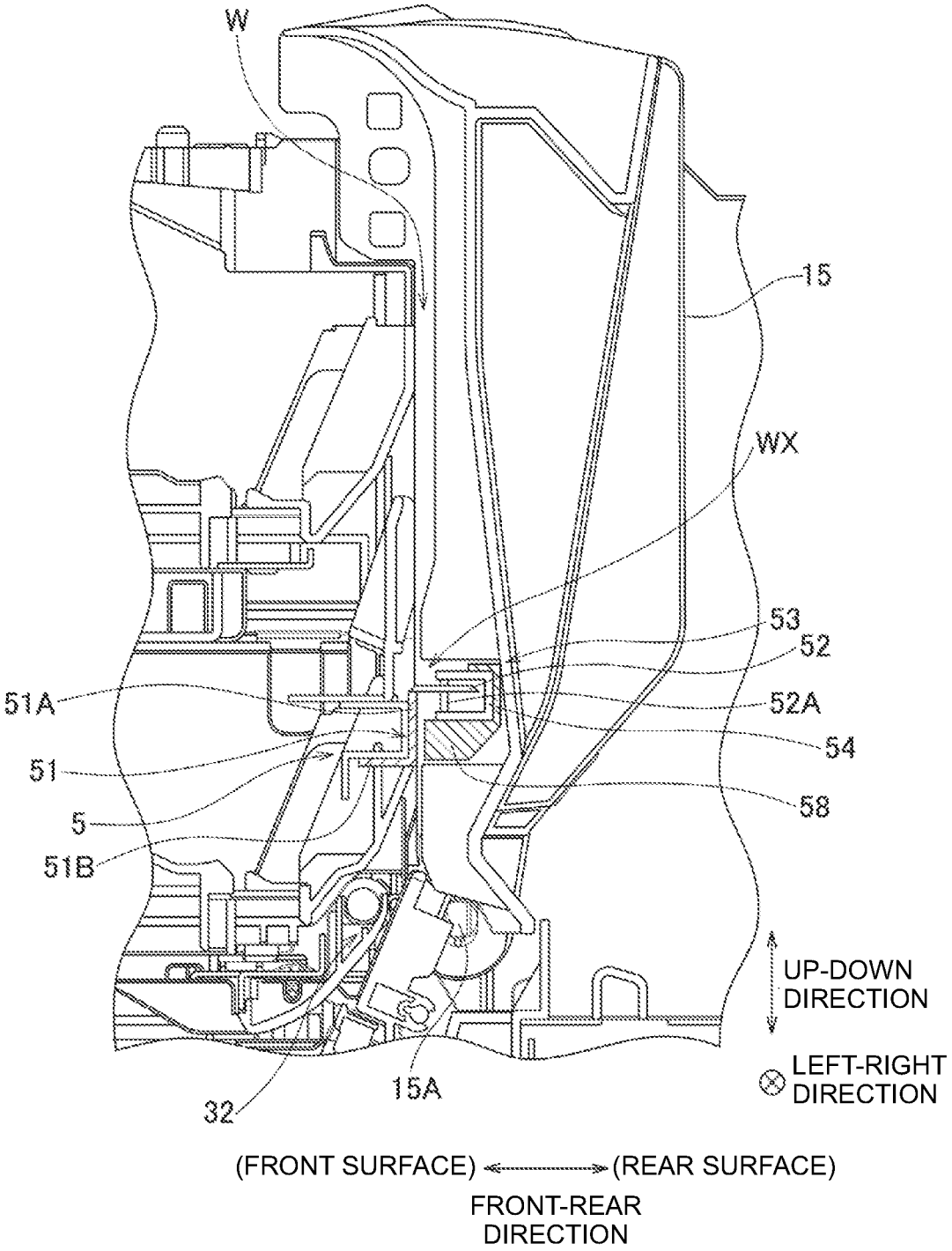
FIG. 3 is a side cross-sectional view depicting a detailed configuration of a cover and a cutting part.
Figure 4A:
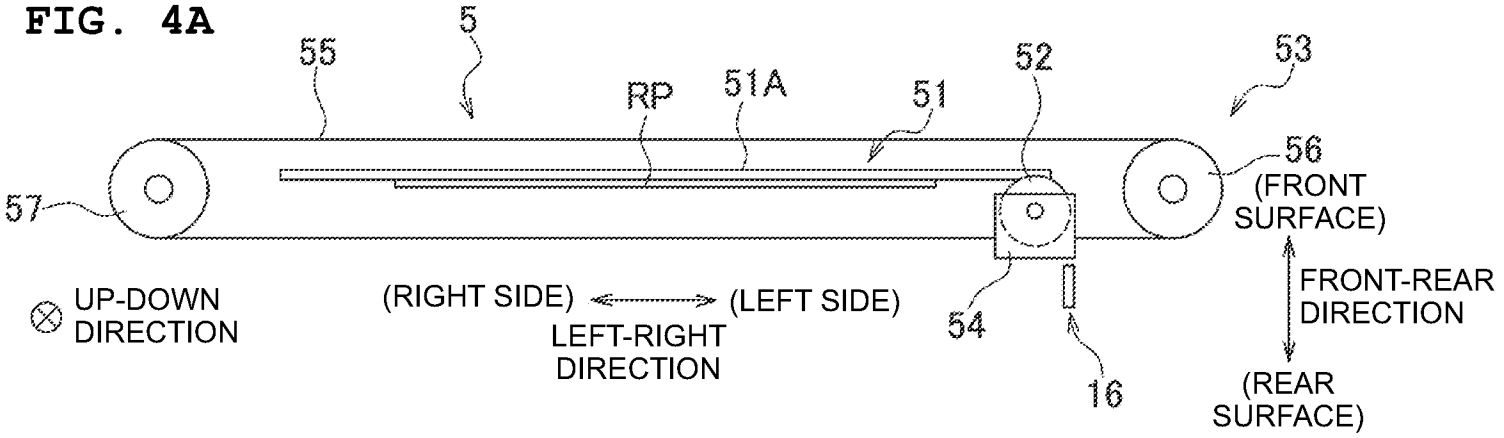
Figure 4B:
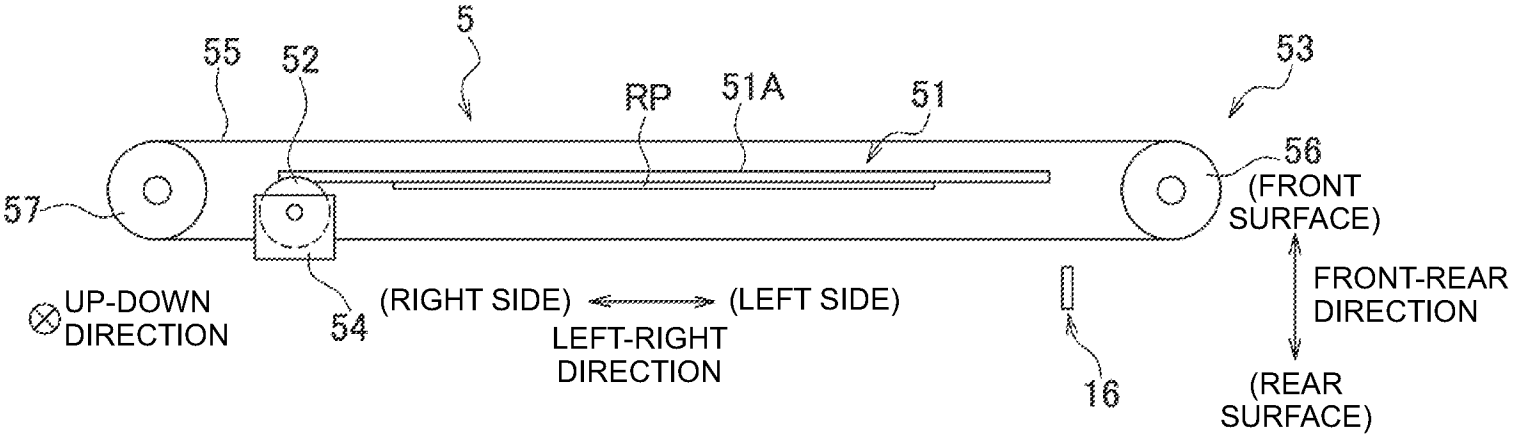
Figure 5A:
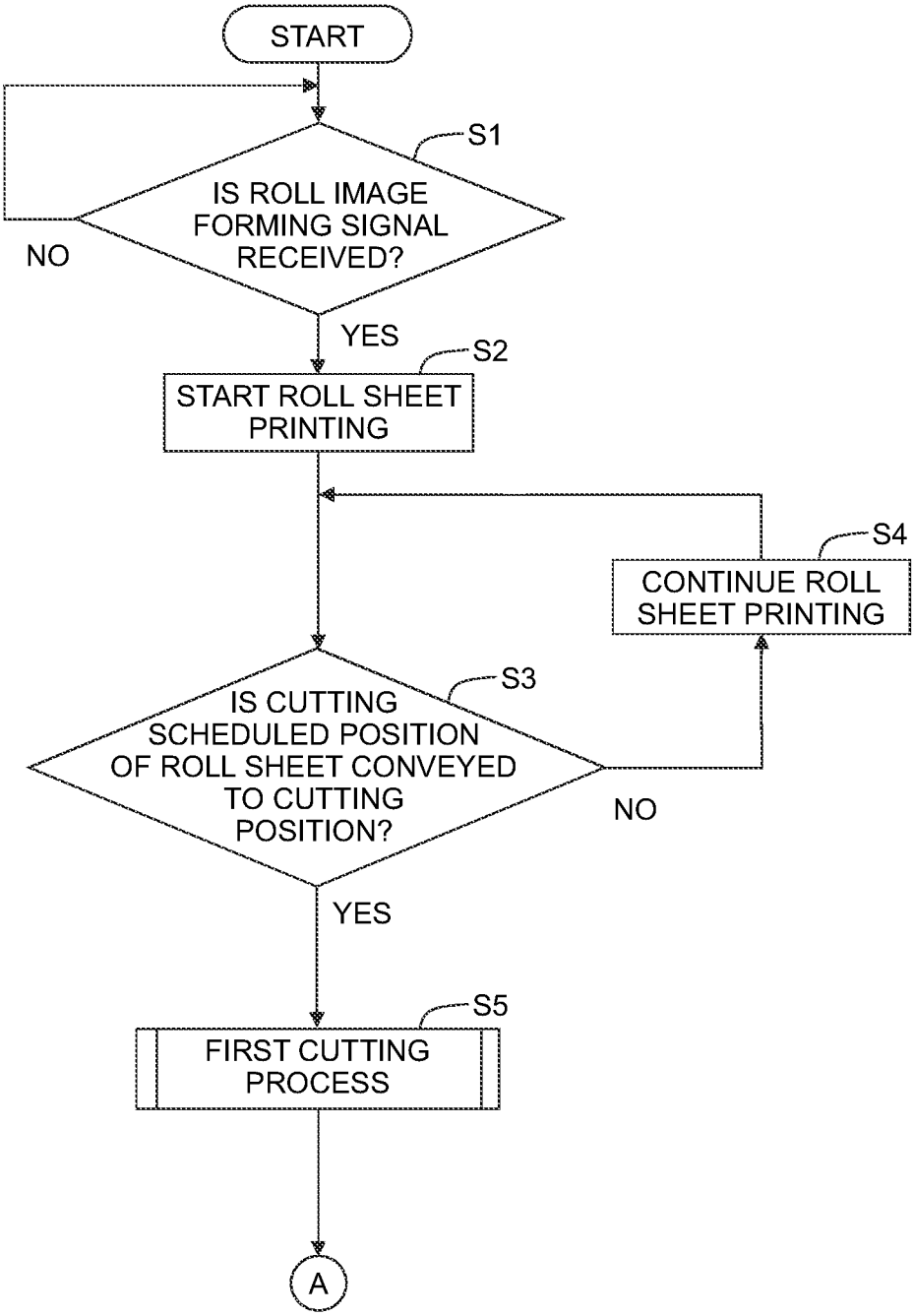
FIGS. 5A to 5D are a flow chart indicating an example of a process to be executed in a case where the printer depicted in FIG. 1 receives a roll image forming signal.
Figure 5B:
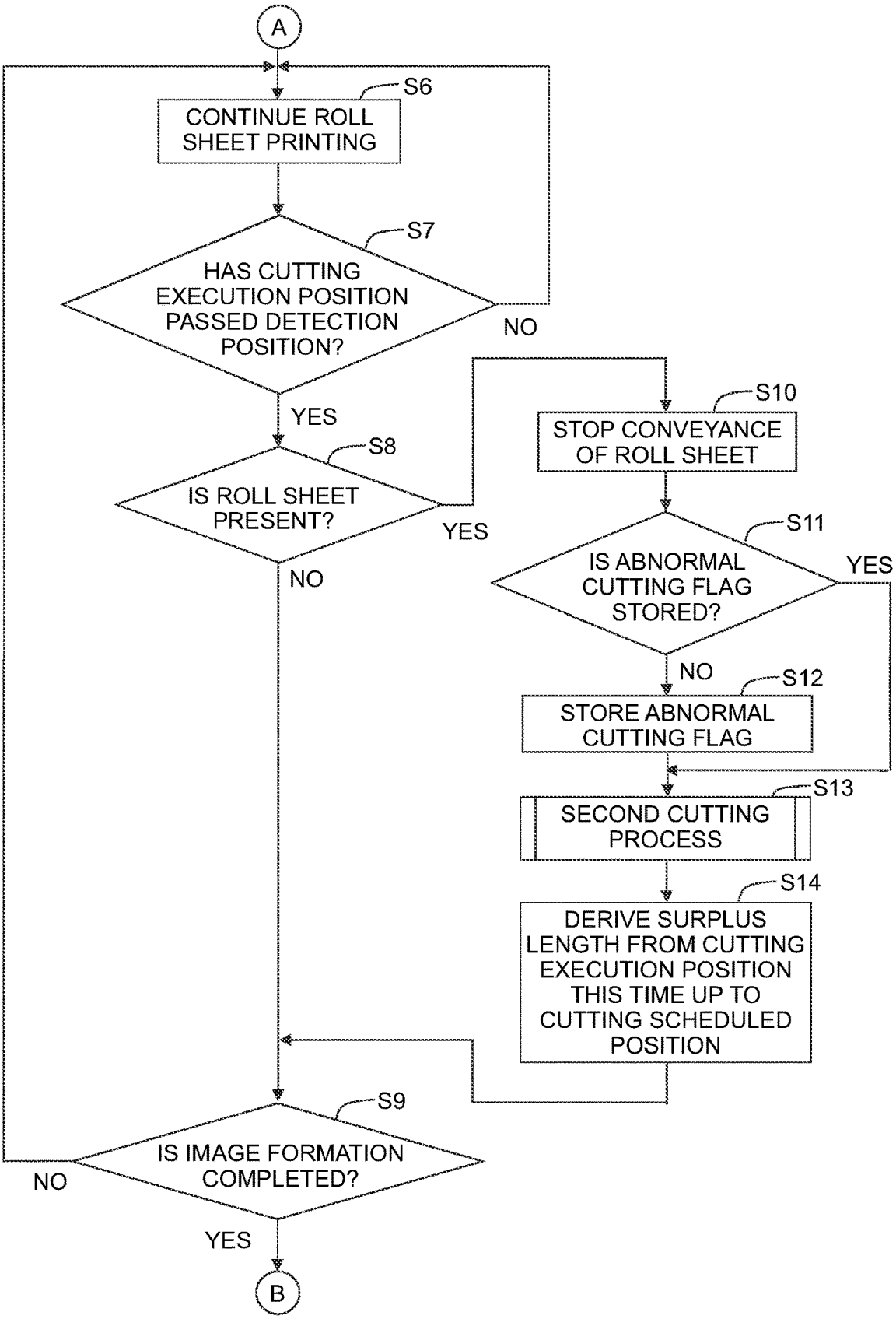
Figure 5C:
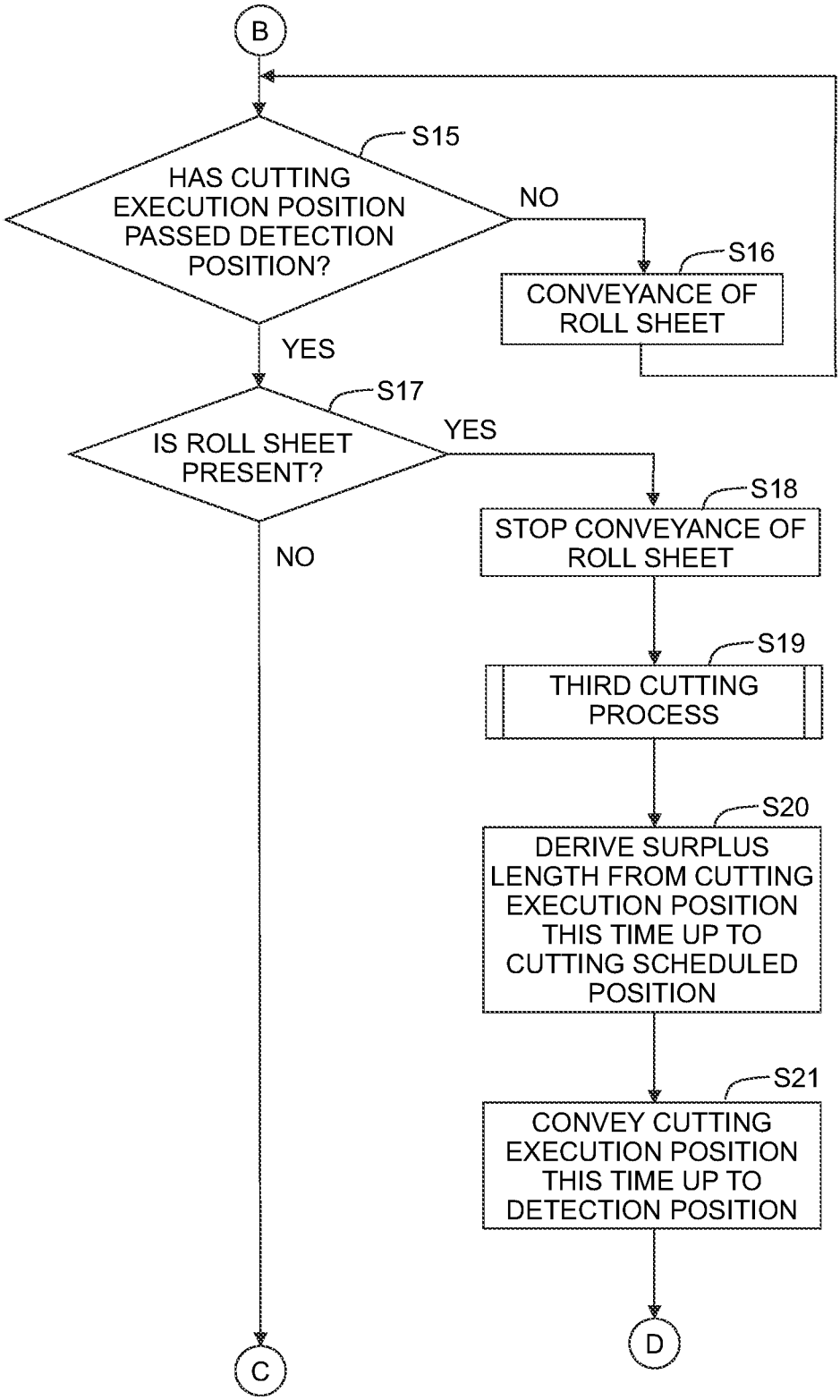
Figure 5D:
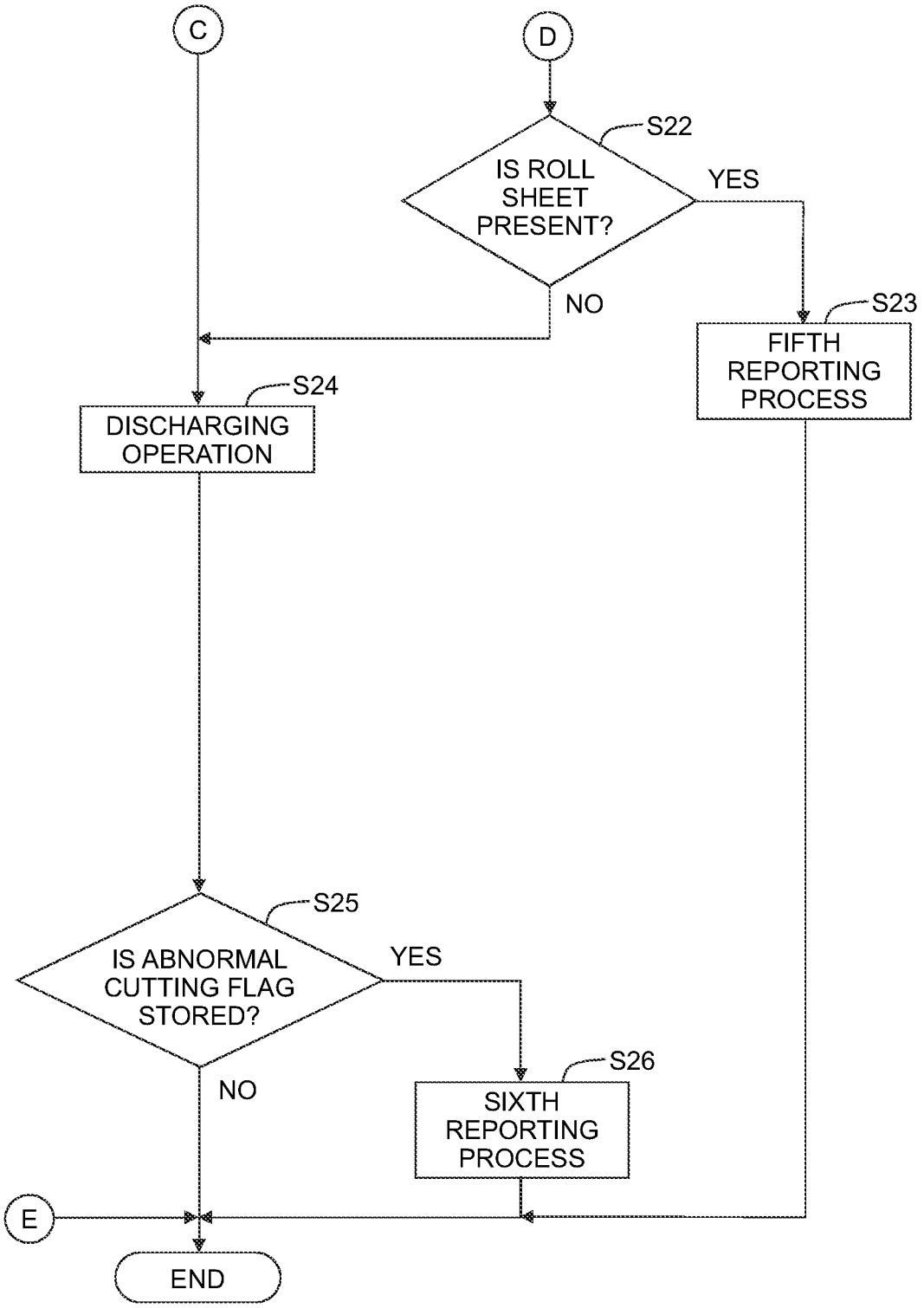
Figure 6A:
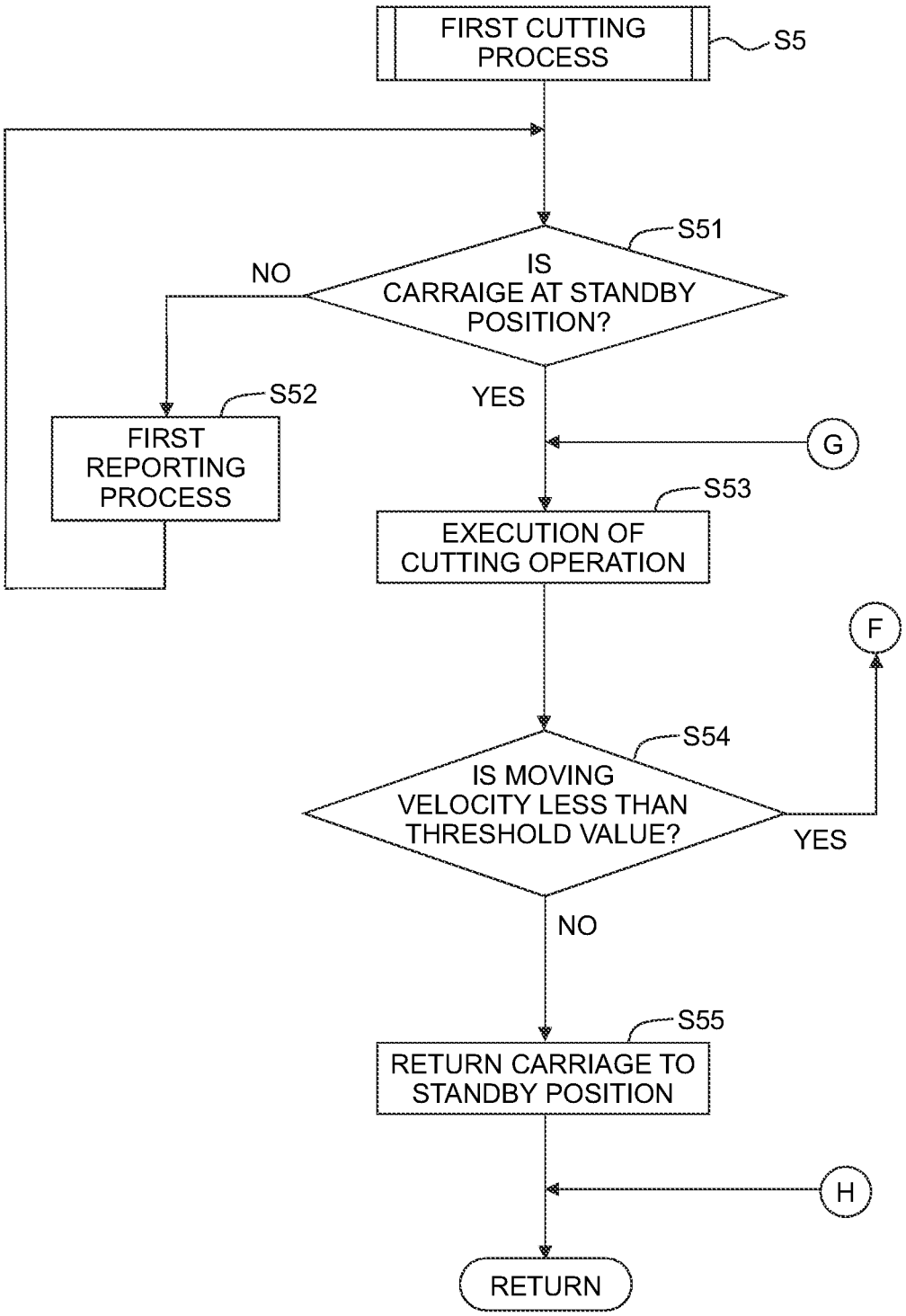
FIGS. 6A and 6B are a flow chart of a first cutting process indicated in FIG. 5A.
Figure 6B:
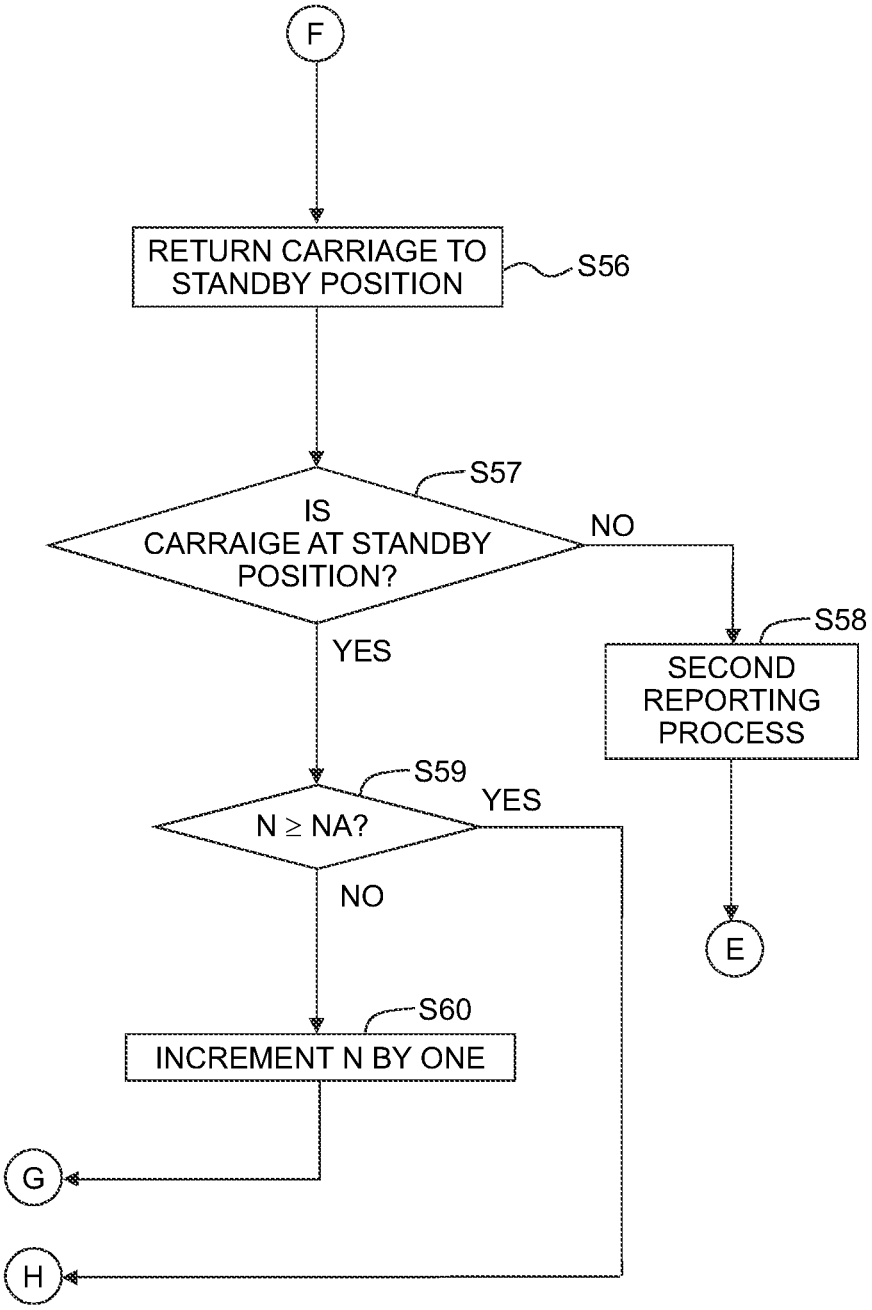
Figure 7A:
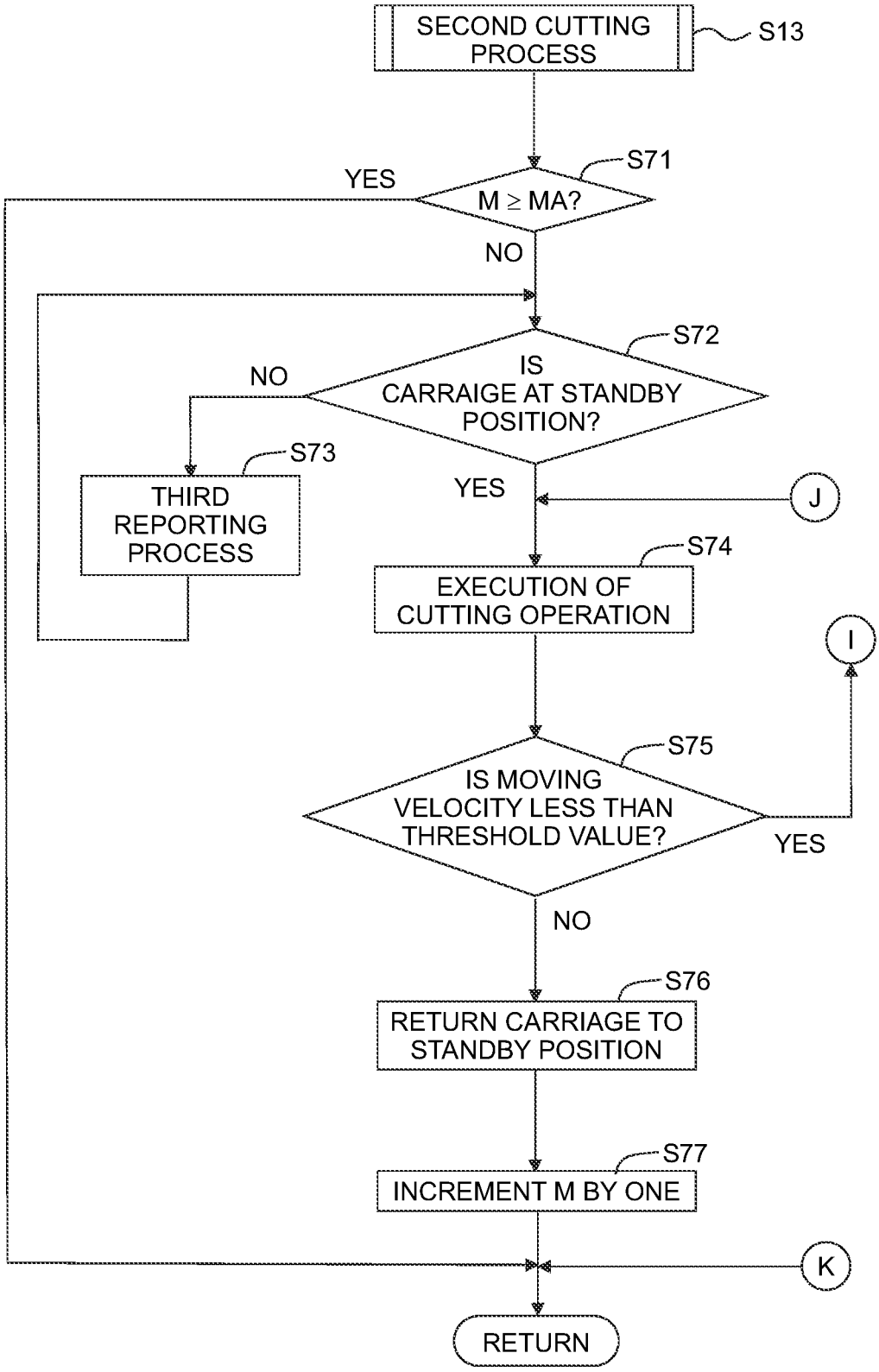
FIGS. 7A and 7B are a flow chart of a second cutting process indicated in FIG. 5B.
Figure 7B:
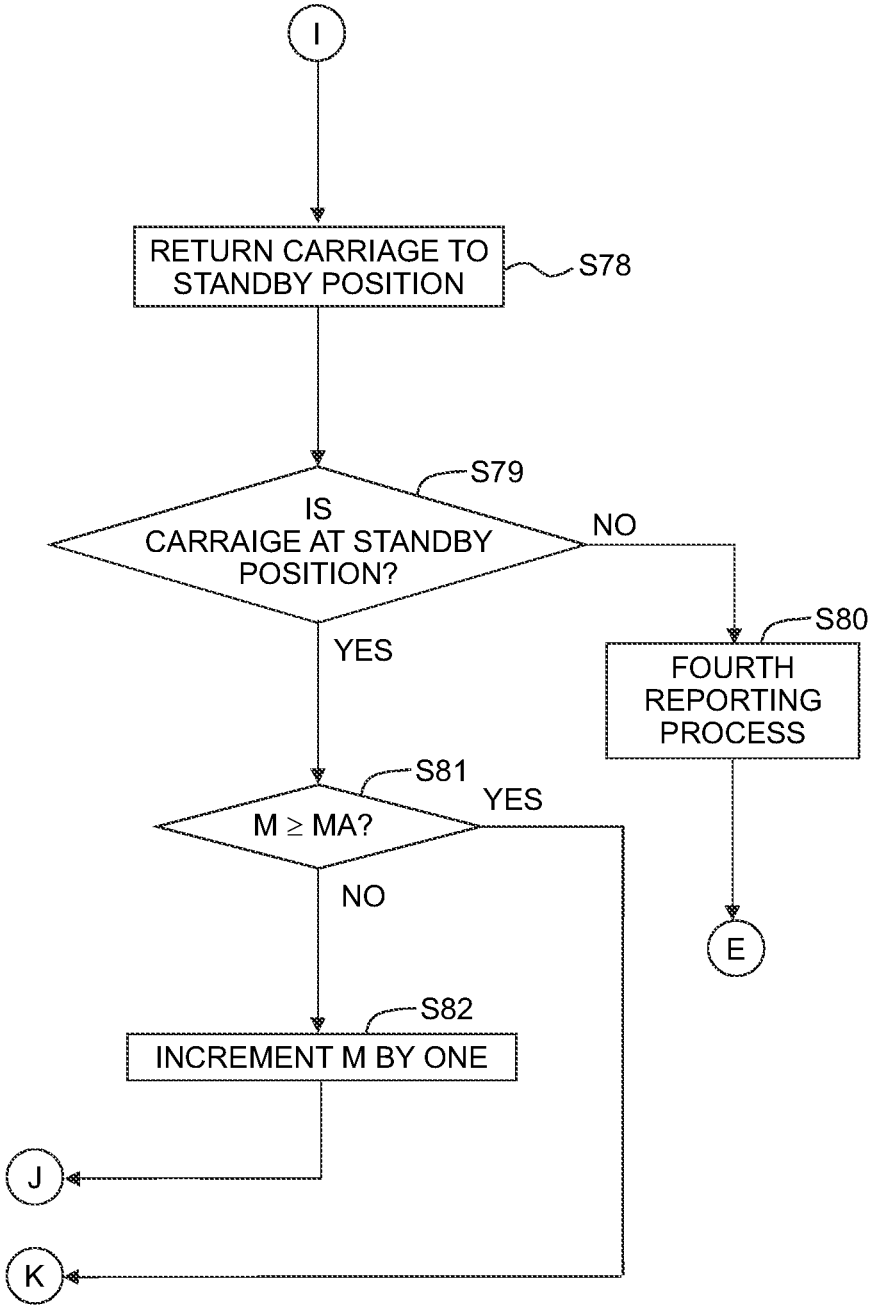

As depicted in FIG. 3, the fixed blade 51 has a vertical part 51A and a horizontal part 51B and is formed to have a L-shaped cross section. The fixed blade 51 is fixed to the casing 11. The vertical part 51A is provided to extend upward from a rear end part of the horizontal part 51B. Further, as depicted in FIGS. 4A and 4B, the fixed blade 51 extends to be long in the left-right direction. More specifically, the fixed blade 51 is formed to be longer than a width (a length in a direction orthogonal to the conveying direction) of the roll sheet RP. The vertical part 51A of the fixed blade 51 is arranged to be contactable with a surface, of the roll sheet RP passing the path WX, which faces frontward.

In a case where the cover 15 is at the closed position (the position indicated by the solid lines in FIG. 1), the rotary blade 52 is positioned inside a groove 15B formed in the surface, of the cover 15, which is oriented frontward. The rotary blade 52 is mounted on a carriage 54 (see FIGS. 4A and 4B) which will be described later on and which is movable along the left-right direction. As depicted in FIG. 3, the rotary blade 52 is disc-shaped, and is supported by the carriage 54 to be rotatable about a shaft 52A extending in the up-down direction. Further, the rotary blade 52 is supported by the shaft 52A to be rotatable in a state that the rotary blade 52 is parallel to the left-right direction. Further, the rotary blade 52 is arranged to be contactable with a surface which is oriented rearward of the roll sheet RP which passes the path WX. Furthermore, the rotary blade 52 is arranged so that a front-side end part of the rotary blade 52 is contactable with an upper end surface of the vertical part 51A of the fixed blade 51.

As depicted in FIGS. 4A and 4B, the moving mechanism 53 has: the carriage 54, a belt 55, a pair of pulleys 56 and 57, a guide rail 58 (see FIG. 3) and a moving motor 53M (see FIG. 2). As depicted in FIG. 3, the entirety of the guide rail 58 is arranged in the groove 15B of the cover 15 which is arranged at the closed position. Further, the guide rail 58 is formed to be elongated along the left-right direction, and supports the carriage 54 to be movable in the left-right direction.

As depicted in FIGS. 4A and 4B, the carriage 54 supports the rotary blade 52 to be rotatable, and the carriage 54 is fixed to the belt 55. The pair of pulleys 56 and 57 are arranged to be apart from each other, while sandwiching the path WX therebetween in the left-right direction. The pulley 56 is a driving pulley to which a turning power is applied by the moving motor 53M. The belt 55 is a ring-shaped endless belt and stretched between the pair of pulleys 56 and 57. The pulley 57 is a driven pulley rotated by the belt 55 which runs by the rotation of the pulley 56.

As depicted in FIG. 4A, the carriage 54 is generally or normally arranged at a standby position at a left side-end part of the fixed blade 51. In this situation, the rotary blade 52 is also arranged at the standby position. Further, in a case of cutting the roll sheet RP, the moving motor 53M is driven to rotate in a normal direction by the control of the controller 8 to thereby run the belt 55, which in turn causes the rotary blade 52 to move rightward together with the carriage 54. In this situation, the rotary blade 52 rotates by friction between the rotary blade 52 and the fixed blade 51. With this, the fixed blade 51 and the rotary blade 52 cooperate with each other so as to cut the sheet RP, which is in the path WX, in a width direction (a direction orthogonal to the conveying direction) of the roll sheet RP, from one end to the other end in the width direction of the roll sheet RP. In such a manner, a cutting operation for cutting the roll sheet RP by the cutting part 5 is performed. By cutting the roll sheet RP, the trailing end of the roll sheet RP is formed. As depicted in FIG. 4B, the carriage 54 and the rotary blade 52 moved rightward are temporarily stopped at a stop position at a right end of the fixed blade 51, when the driving of the moving motor 53M is stopped. Afterward, the moving motor 53M is driven to rotate in a reverse direction to cause the rotary blade 52 to move leftward together with the carriage 54, thereby returning the rotary blade 52 and the carriage 54 to the standby position as depicted in FIG. 4A.

The cutter sensor 16 is arranged at a position at which the cutter sensor 16 is capable of detecting the carriage 54 arranged at the standby position. The cutter sensor 16 is, for example, a photosensor of a transmission type or a reflective type having a light-emitting element configured to emit a light toward the carriage 54 arranged at the standby position and a light-receiving element (both of which are not illustrated in the drawings). It is possible to detect whether the carriage 54 is at the standby position, by a change in an output signal from the cutter sensor 16. Namely, by a change from a state that the carriage 54 is not at the standby position to a state that the carriage 54 is at the standby position, or by a change from the state that the carriage 54 is at the standby position to the state that the carriage 54 is not at the standby position, it is possible to detect whether the carriage 54 is at the standby position. With this, it is possible to detect the presence or absence of the carriage 54 at the standby position. Note that it is allowable that the cutter sensor 16 is constructed, for example, of a mechanical switch, a proximity sensor, etc., and the configuration of the cutter sensor 16 is not particularly limited.

The encoder 17 is provided on a transmitting mechanism (not depicted in the drawings) configured to transmit the turning power to be applied from the moving motor 53M to the pulley 56. The encoder 17 is configured to output a signal indicating a position to which the rotary blade 52 is moved from the standby position by the rotation of the moving motor 53M, and a signal indicating a moving velocity in the above-described movement of the moving motor 53. In the present embodiment, although a rotary encoder is adopted as the encoder 17, it is allowable to adopt a linear encoder as the encoder 17.

The sheet detecting sensor 10 (a "signal outputting part" of the present disclosure) is located between the cutting part 5 and the conveying roller pair 33 in the conveying direction, and immediately downstream of the cutting part 5. Further, the sheet detecting sensor 10 is, for example, a photosensor of a transmission type or a reflective type having a light-emitting element (not depicted in the drawings) configured to emit a light toward the conveyance path W of the sheet P (a path immediately downstream of the path WX) and a light-receiving element (not illustrated in the drawings). It is possible to detect whether the sheet P is at a detecting position (a position facing or opposite to a front end surface 10A of the sheet detecting sensor 10) by a change in an output signal (a "state signal" of the present disclosure) from the sheet detecting sensor 10. Namely, in a case where a state that the sheet P is present at the detection position (a "predetermined position" of the present disclosure) in the conveyance path W is changed to a state that the sheet P is not present at the detection position in the conveyance path W, it is possible to detect that the trailing end of the sheet P (including a trailing end formed by cutting of the roll sheet RP) passes the detection position. With this, it is possible to determine the presence or absence of a cutting of the roll sheet RP by the cutting part 5. Note that it is allowable to construct also the sheet detection sensor 10 of a mechanical switch, a proximity sensor, etc.; the configuration of the sheet detecting sensor 10 is not particularly limited.

The head 6 (an "image forming part" of the present disclosure) is arranged between the conveying roller pair 34 and the conveying roller pair 35. The head 6 includes a plurality of nozzles (not depicted in the drawings) formed in a lower surface of the head 6, and a driver IC 6A (see FIG. 2). In a case where the driver IC 6A is driven by a control of the controller 8, the head 6 is configured to eject ink (an "image forming agent" of the present disclosure), which is supplied from an ink cartridge (not depicted in the drawings), from the plurality of nozzles and to form an image with respect to the sheet P being conveyed by the conveying roller pair 34. The sheet P on which the image is formed is conveyed frontward (leftward in FIG. 1) by the conveying roller pair 35. Note that the head 6 may be either one of a head of the line system which is configured to eject the ink from the nozzles in a state that the position thereof is fixed and a head of the serial system which is configured to eject the ink from the nozzles while moving in the left-right direction (main scanning direction).

The discharge tray 7 is configured to receive the sheet P conveyed frontward by the conveying roller pair 35. The sheet P accommodated in the discharge tray 7 is the roll sheet RP in which the trailing end is formed by the cutting part 5 and on which the image is formed by the head 6, and the cut sheet KP on which the image is formed by the head 6.

The reporting part 9 is configured to perform a reporting operation of reporting a user about information. The reporting part 9 is, for example, a display provided on the printer 1 and configured to display, to the user, information which is to be reported with respect to the user (for example, a message), thereby executing the reporting operation with respect to the user. Further, the reporting part 9 may be, for example, a speaker provided on the printer 1, and may be configured to output the information which is to be reported with respect to the user by a voice and/or sound, thereby executing the reporting operation with respect to the user.

Next, the controller 8 which controls the entirety of the printer 1 will be described, with reference to FIG. 2. The controller 8 includes a CPU (Central Processing Unit) 81, a ROM (Read Only Memory) 82, a RAM (Random Access Memory) 83, an ASIC (Application Specific Integrated Circuit) 84, a flash memory 85, etc., which are connected to one another by a bus. The above-described constituent components of the controller 8 cooperate with one another to control the operation of each of the driver IC 6A, the feeding motor 31M, the conveying motor 37M, the moving motor 53M, the reporting part 9, etc. Note that a signal from each of the sheet detecting sensor 10, the cutter sensor 16 and the encoders 17 and 36 is inputted to the controller 8.

Note that the controller 8 may be configured such that only the CPU 81 performs the various kinds of processing or that only the ASIC 84 performs the various kinds of processing, or that the CPU 81 and the ASIC 84 perform the various kinds of processing in a cooperative manner. Alternatively, the controller 8 may be configured such that one CPU 81 singly performs the processing, or that a plurality of CPUs 81 performs the processing in a sharing manner. Still alternatively, the controller 8 may be configured such that one ASIC 84 singly performs the processing, or that a plurality of ASICs 84 performs the processing in a sharing manner.

[Control of the Roll Sheet Printing]

Next, a description will be given about a control by the controller 8 at a time of performing a roll sheet printing by which an image is formed on the roll sheet RP. The controller 8 performs processing in accordance with a process depicted in FIGS. 5A to 7B in response to receiving a roll image forming signal for executing the roll sheet printing. The roll image forming signal is a signal instructing that the image is to be formed on the roll sheet RP in the printer 1, and is transmitted to the controller 8 from an external apparatus, etc.

To provide a more detailed description regarding the process of FIGS. 5A to 5D, at first, the controller 8 determines whether the roll image forming signal is received (step S1). In a case where the roll image forming signal is not received (step S1: NO), the controller 8 repeats step S1. In a case where the roll image forming signal is received (step S1: YES), the controller 8 starts the roll sheet printing (step S2: "image forming process" of the present disclosure). Namely, the controller 8 conveys, in the conveying direction, the roll sheet RP from the feed cassette 2 by the conveyor 3. Further, the controller 8 forms, by the head 6, an image on the roll sheet RP conveyed by the conveyor 3.

Next, the controller 8 determines whether a cutting scheduled position of the roll sheet RP is conveyed to an actual cutting position (the upper end of the vertical part 51A of the fixed blade 51) of the cutting part 5 (step S3). Note that the cutting scheduled position of the roll sheet RP is derived based on the roll image forming signal received by the controller 8. Further, the determination whether the cutting scheduled position of the roll sheet RP is conveyed to the cutting portion is made based on a conveyance amount, of the sheet P, which is derived based on the signal from the encoder 36.

In a case where the cutting scheduled position of the roll sheet RP is not conveyed so as to reach up to the cutting position (step S3: NO), the controller 8 continues the roll sheet printing (step S4), and returns to step S3. On the other hand, in a case where the cutting scheduled position of the roll sheet RP is conveyed so as to reach up to the cutting position (step S3: YES), the controller 8 once stops the conveyance of the roll sheet RP, and proceeds to step S5.

In step S5, the controller 8 executes a first cutting process. Here, the first cutting processing will be described with reference to FIGS. 6A and 6B. In the first cutting processing, at first, the controller 8 determines whether the carriage 54 is at the standby position (step S51). In a case where the signal from the cutter sensor 16 is a signal indicating that the carriage 54 is detected, the controller 8 determines that the carriage 54 is at the standby position; in a case where the signal from the cutter sensor 16 is a signal indicating that the carriage 54 is not detected, the controller 8 determines that the carriage 54 is not at the standby position.

In a case where the carriage 54 is not at the standby position (step S51: NO), the controller 8 executes a first reporting process (step S52). In the first reporting process, the controller 8 causes the reporting part 9 to execute a reporting operation of reporting the user of information indicating that the carriage 54 is not present at the standby position (for example, such a case that the carriage 54 is detached due to, for example, a maintenance of the rotary blade 52, etc.). Further, in the first reporting process, the controller 8 causes the reporting part 9 to execute a reporting operation of reporting the user of information indicating that the carriage 54 and the rotary blade 52 are to be arranged at the standby position. Afterwards, the controller 8 returns to step S51.

In a case where the carriage 54 is at the standby position (step S51: YES), the controller 8 executes the cutting operation (step S53; the "cutting process" of the present disclosure). Namely, the controller 8 controls the moving motor 53M so that the rotary blade 52 is moved, together with the carriage 54, from the standby position up to the stop position.

Next, the controller 8 determines whether a moving velocity of the rotary blade 52, from when the rotary blade 52 passes one end (which is closer to the standby position) of the roll sheet RP to when the rotary blade 52 passes the other end (which is closer to the stop position) of the roll sheet RP, is less than a threshold value (step S54). Namely, the controller 8 determines whether the moving velocity from when the cutting operation of the roll sheet RP is started to when the cutting operation of the roll sheet RP is ended is less than the threshold value.

In a case where the moving velocity is at or beyond the threshold value (step S54: NO), the controller 8 proceeds to step S55. In this situation, the rotary blade 52 smoothly passes from the one end up to the other end of the roll sheet RP. The controller 8 controls, in step S55, the moving motor 53M so as to return the carriage 54 stopped at the stop position to the standby position. In such a manner, the controller 8 proceeds to step S6.

On the other hand, in a case where the moving velocity is less than the threshold value (step S54: YES), the controller 8 proceeds to step S56. In this situation, any hindrance or difficulty is generated, due to any cause, in the movement of the rotary blade 52 between the rotary blade 52 and the roll sheet RP. The controller 8 controls, in step S56, the moving motor 53M so as to return the carriage 54 to the standby position.

Next, the controller 8 determines whether the carriage 54 is at the standby position (step S57), in a similar manner as in step S51. In a case where the carriage 54 is not at the standby position (step S57: NO), the controller 8 executes a second reporting process (step S58). In the second reporting process, the controller 8 causes the reporting part 9 to execute a reporting operation of reporting the user of information indicating that the carriage 54 is to be returned to the standby position manually (for example, a jam (paper jam) occurs in the roll sheet RP in the cutting part 5, etc.). Further, in this situation, the controller 8 causes the reporting part 9 to execute an operation, as the reporting operation, of urging that the cover 15 is to be opened and that the roll sheet RP is to be manually cut and removed.

Here, a description will be given about a procedure of clearing jam (paper jam) to be executed by the user. At first, as depicted in broken lines in FIG. 1, the cover 15 is moved from the closed position to the open position. With this, the path W is exposed to the outside. Namely, the roll sheet RP and the carriage 54 are exposed. The exposed carriage 54 is manually returned to the standby position, and the exposed roll sheet RP is cut at an appropriate position by using, for example, scissors, etc. Afterwards, the cover 15 is moved to the closed position, and the roll sheet PR is pulled frontward from the discharge tray 7 and is removed. Afterwards, the process indicated in FIGS. 5A to 5D is ended.

In a case where the carriage 54 is at the standby position (step S57: YES), the controller 8 determines whether the number of retries N is a threshold value NA or more (step S59). The number of retries N is the number of times by which the cutting operation has been repeated at the same position of the roll sheet RP. The threshold value NA in the present embodiment is set to 1 (one time), and may be changed as appropriate. Note that the number of retries N is reset to 0 (zero) every time the cutting process is ended. Further, the number of retries N may be reset to 0 (zero) every time a new cutting operation (the first cutting processing, a second cutting process and a third cutting process which will be described later on) is started.

In a case where the number of retries N is less than the threshold value NA (step S59: NO), the controller 8 increments the number of retries N by one (step S60), and the controller 8 returns to step S53. On the other hand, in a case where the number of retries N is the threshold value NA or more (step S59: YES), the cutting operation is executed a predetermined number of times (twice in the present embodiment) at the same position in the roll sheet RP, and thus the controller 8 proceeds to step S6.

Next, the controller 8 continues the roll sheet printing in step S6. Further, the controller 8 determines whether a cutting execution position (here, a cutting scheduled position) at which the cutting operation has been executed with respect to the roll sheet RP has passed the detection position (step S7). In a case where the cutting execution position has not passed the detection position (step S7: NO), the controller 8 returns to step S6. Furthermore, whether or not the cutting execution position of the roll sheet RP has passed the detection position is also determined by the conveyance amount of the sheet P derived based on the signal from the encoder 36.

On the other hand, in a case where the cutting execution position has passed the detection position (step S7: YES), the controller 8 determines whether the roll sheet RP is present at the detection position (step S8). In other words, the controller 8 determines whether the roll sheet RP is present at the detection position until a predetermined time (a "first time" of the present disclosure) elapses since the cutting operation of step S53 or step S74 (which is to be described later on) has been executed. The term "predetermined time" is a period of time for which the cutting execution position, which is expected to be cut by the cutting operation, is conveyed up to a position just beyond the detection position. Note that in the above-described time, errors in a detection timing by the sheet detecting sensor 10 and the conveyance precision of the roll sheet RP are considered to some extent; the above-described time is a time with which the sheet detecting sensor 10 comes to output, in an ensured manner, an output signal indicating that the roll sheet RP is not present provided that the roll sheet RP has been cut. In step S8, in a case where the roll sheet RP is not present (step S8: NO), namely, in a case where the controller 8 receives, from the sheet detecting sensor 10, an output signal indicating that the roll sheet RP has been cut by the cutting operation, that the trailing end of the roll sheet RP has passed the detection position, and that the roll sheet RP is not present at the detecting position, the controller 8 determines whether image formation with respect to the roll sheet RP by the roll sheet printing has been completed (step S9). The determination as to whether or not the image formation has been completed is made, by the controller 8, based on the roll image formation signal received by the controller 8.

In a case where the roll sheet RP is present (step S8: YES), namely, in a case where the roll sheet RP is not cut by the cutting operation and that the controller 8 does not receive, from the sheet detecting sensor 10, the output signal indicating that the roll sheet RP is not present at the detection position, the controller 8 controls the conveyor 3 so as to once stop the conveyance of the roll sheet RP (step S10). Further, the controller 8 determines whether an abnormal cutting flag is stored in the flash memory 85 (step S11). In a case where the abnormal cutting flag is not stored (step S11: NO), the controller 8 causes the flash memory 85 to store the abnormal cutting flag (step S12). The abnormal cutting flag indicates that even though the cutting operation has been executed with respect to the roll sheet RP, the roll sheet RP is not cut due to any cause or reason. In a case where the abnormal cutting flag is stored (step S11: YES), the controller 8 proceeds to step S13. Note that the abnormal cutting flag stored in the flash memory 85 is deleted or erased from the flash memory 85 every time the process indicated in FIGS. 5A to 5D is ended, or every time the process indicated in FIGS. 5A to 5D is started.

Next, in step S13, the controller 8 executes a second cutting process. Here, the second cutting process will be described with reference to FIGS. 7A and 7B. In the second cutting process, at first, the controller 8 determines whether the number of retries M is a threshold value MA or more (step S71). The number of retries M ("the number of executions" of the present disclosure) is the number of times by which the cutting operation has been executed at a position which is different from the cutting scheduled position of the roll sheet RP and at which the cutting operation has been never executed. The threshold value MA in the present embodiment is set to 2 (two times), and may be changed as appropriate. Note that the number of retries M is also reset to "0" (zero) every time the process indicated in FIGS. 5A to 5D is ended. Alternatively, the number of retries M may be reset to "0" (zero) every time the process indicated in FIGS. 5A to 5D is newly started.

In a case where the number of retries M is the threshold value MA or more (step S71: YES), since the cutting operation of the roll sheet RP has been executed at the different position for a predetermined number of times (two times in the present embodiment), the controller 8 ends the second cutting process.

On the other hand, in a case where the number of retries M is less than the threshold value MA (step S71: NO), the controller 8 executes a processing step similar to that of step S51 as described above (step S72). In a case where the carriage 54 is not at the standby position (step S72: NO), the controller 8 executes a third reporting process which is similar to the above-described first reporting process (step S73). Afterwards, the controller 8 returns to step S72.

In a case where the carriage 54 is at the standby position (step S72: YES), the controller 8 executes step S74 to S76 which are similar to the above-described steps S53 to S55. Afterwards, the controller 8 increments the number of retries M by one (step S77).

Next, the controller 8 executes steps S78 and S79 which are similar to the above-described steps S56 and S57. In a case where the carriage 54 is not at the standby position (step S79: NO), the controller 8 executes a fourth reporting process which is similar to the above-described second reporting process (step S80). Afterwards, the process indicated in FIGS. 5A to 5D is ended.

In a case where the carriage 54 is at the standby position (step S79: YES), the controller 8 executes steps S81 and S82 which are similar to the above-described steps S59 and S60.

Returning to FIGS. 5A to 5D, the controller 8 derives a surplus length from a cutting execution position, of the roll sheet RP, to be executed this time up to the cutting scheduled position, based on the number of retries M (step S14), and proceeds to step S9. The surplus length is derived by multiplying, by the number of retries M, a distance from the cutting scheduled position to the detection position. The cutting executing position is a position of the roll sheet RP at which the cutting operation of step S74 has been executed in the second cutting process, immediately before execution of step S14.

In step S9, in a case where the image formation with respect to the roll sheet RP by the roll sheet printing is not completed (step S9: NO), the controller 8 returns to step S6. On the other hand, in a case where the image formation with respect to the roll sheet RP by the roll sheet printing is completed (step S9: YES), the controller 8 determines whether the cutting execution position has passed the detection position (step S15). The term "cutting execution position" referred to herein is the cutting scheduled position in a case where the procedure has been advanced not via step S13; whereas the term "cutting execution position" referred to herein is the position of the roll sheet RP at which the cutting operation of step S74 has been performed in the second cutting process executed immediately before, in a case where the procedure has been advanced via step S13. In a case where the cutting execution position has not passed the detection position (step S15: NO), the controller 8 controls the conveyor 3 so as to convey the roll sheet RP (step S16). Then, the controller 8 returns to step S15.

On the other hand, in a case where the cutting execution position has passed the detection position (step S15: YES), the controller 8 executes a processing step similar to that of step S8 as described above (step S17). In a case where the roll sheet RP is present (step S17: YES), the controller 8 once stops the conveyance of the roll sheet RP (step S18). Then, the controller 8 executes a third cutting process which is similar to the above-described second cutting process (step S19). Note that in a case where the third cutting process is executed, the image formation has been completed. Due to this, a reporting process, which is included in the reporting processes executed in the third cutting process and which is similar to the second reporting process, may include information indicating that the image formation has been continued.

Next to step S19, the controller 8 executes step S20 which is similar to step S14 as described above. Note that in a case where the controller 8 executes step S20, the controller 8 updates the surplus length derived in step S14 to a surplus length derived in step S20.

Next to step S20, the controller 8 controls the conveyor 3 so as to convey the roll sheet RP until the cutting scheduled position of this time passes the detection position, and then to once stop the conveyance of the roll sheet RP (step S21).

Next to step S21, the controller 8 executes a processing step similar to that of step S8 as described above (step S22). In a case where the roll sheet RP is present (step S22: YES), the controller 8 executes a fifth reporting process (step S23). In the fifth reporting process, the controller 8 causes the reporting part 9 to execute a reporting operation of reporting information indicating that the roll sheet RP is not cut even though the controller 8 has executed the cutting operation at a different position of the roll sheet RP.

Further, in the fifth reporting process, the controller 8 causes the reporting part 9 to execute, as the reporting operation, an operation of reporting information of urging to open the cover 15 and to cut and remove the roll sheet RP manually. Note that since a procedure for the user to manually cut and remove the roll sheet RP is substantially the same as the procedure of clearing jam, any description therefor will be omitted.

Furthermore, in the fifth reporting process, the controller 8 causes the reporting part 9 to execute, as the reporting operation, an operation of reporting information urging an exchange of, for example, the rotary blade 52 of the cutting part 5, etc. Afterwards, the process indicated in FIGS. 5A to 5D is ended.

On the other hand, in a case where the roll sheet RP is not present in step S22, (step S22: NO), the controller 8 determines that the roll sheet RP has been cut in the cutting operation in step S19 ("to execute the cutting process again" of the present disclosure), and the controller 8 executes a discharging operation (step S24). In the discharging operation, the controller 8 controls the conveyor 3 so as to convey the roll sheet RP in the conveying direction. In this situation, the controller 8 controls the conveyor 3 so that the conveyance of the roll sheet RP is stopped immediately before a trailing end of the roll sheet RP (a trailing end, of the roll sheet RP, formed by being cut) has completely passed the conveying roller pair 35 (a "roller pair which is a most downstream roller pair" in the present disclosure), namely, so that the conveyance of the roll sheet RP is stopped in a state that a downstream part of the roll sheet RP, which is downstream of the trailing end of the roll sheet RP in the conveying direction, is held by the conveying roller pair 35.

Next, the controller 8 executes a processing step similar to that of step S11 (step S25). In a case where the abnormal cutting flag is stored (step S25: YES), the controller 8 executes a sixth reporting process (step S26). In the sixth reporting process, the controller 8 causes the reporting part 9 to execute a reporting process of reporting information indicating that the roll sheet RP is not cut at the cutting scheduled position of the roll sheet RP. Further, the information of the reporting process includes information indicating that the image formation has been continued and that the image formation has been completed. Furthermore, in a case where the surplus length has been derived via step S14 or step S20, the above-described information includes information indicating that a blank of the surplus length (an excessive blank) is present in the trailing end part of the roll sheet RP. Moreover, the above-described information includes information urging the user to manually cut the blank at the trailing end part of the roll sheet RP.

On the other hand, in a case where the abnormal cutting flag is not stored (step S25: NO), the controller 8 determines that the roll sheet RP is cut normally by the first cutting processing in step S5, and ends the process.

As described above, according to the printer 1 of the present embodiment, even in a case where, in step S8, it is not determined that the roll sheet RP is cut during the image formation (at some point while the image formation is in progress), the image formation is continued without being interrupted unless the procedure proceeds to step S58 or step S80. Namely, even in a case where the roll sheet RP is not cut despite that the cutting operation of the first cutting processing is executed during the image formation, the image formation is executed until the image formation is completed. Owing to this, the roll sheet RP (a part of the roll sheet RP), on which the image formation has been already performed until a point of time at which it is determined that the roll sheet RP has not been cut (step S8), can be utilized effectively. This can reduce wasteful consumption of the roll sheet RP and the ink (image forming agent). Further, in step S8, in a case where the roll sheet RP is determined to be present, namely, in a case where the roll sheet RP has not been cut, the user is capable of grasping the information regarding the cutting failure of the roll sheet RP by the sixth reporting process of step S26.

In a case where the controller 8 determines in step S8 that the roll sheet RP is present, the controller 8 stores the abnormality cutting flag in the flash memory 85, and executes the sixth reporting process in step S26. Owing to this, the user is capable of grasping that the roll sheet RP is not cut. Further, the user is capable of grasping that the image formation has been continued. Further, in a case where the surplus length is derived via step S14 or step S20, the user is capable of grasping that the user is to open the cover 15 and to cut the roll sheet RP manually. Furthermore, the user is capable of grasping that there is a blank in the trailing end part of the roll sheet RP. Further, the user can be urged to manually cut the blank of the trailing end part of the roll sheet RP. Accordingly, the user is easily capable of grasping how to handle the blank of the trailing end part of the roll sheet RP. Further, the user is capable of grasping that the blank having a length of which extent is present in the trailing end part of the roll sheet RP.

The cutting part 5 is disposed upstream of the head 6 in the conveying direction. The cutting operation is performed often during the image formation, as compared with a case where the cutting part 5 is disposed downstream of the head 6 in the conveying direction. Due to this, the configuration wherein the image formation with respect to the roll sheet RP is continued, without being interrupted, in a case where the roll sheet RP is not cut is more efficient. In a case where the cutting part 5 is disposed downstream of the head 6 in the conveying direction, the cutting operation is not performed during the image formation in such a case where a next image is not formed on the roll sheet RP. Accordingly, in a case of the roll sheet printing wherein the next image is formed on the roll sheet RP, an effect similar to the above-described effect can be obtained.

In a case where the controller 8 determines that the roll sheet RP is present in step S8 and step S17, the controller 8 stops the conveyance of the roll sheet RP in step S10 and step S18, respectively. This can prevent the expansion of a blank space upstream of, in the conveying direction, an image area of the image formed by the head 6.

In a case where the controller 8 determines in step S8 that the roll sheet RP is present, the controller 8 determines that the roll sheet RP is not cut in in step S53. The controller 8 can thus determine whether the roll sheet RP is cut by the cutting operation at a comparatively early timing, as compared with the case that the sheet detecting sensor 10 is disposed downstream of the head 6 in the conveying direction. Owing to this, to the controller 8 can quickly perform a procedure after the determination.

In a case where the controller 8 determines in step S17 or in step S22 that the roll sheet RP is not present, the controller 8 proceeds to step S24, and the controller 8 controls the conveyor 3 so that the conveyance of the roll sheet RP is stopped immediately before the trailing end of the roll sheet RP has completely passed the conveying roller pair 35 in the discharging operation. With this, even in a case where the roll sheet RP is lengthy, it can prevent situations where the roll sheet RP is discharged out of the printer 1, falls on the floor, and could become soiled.

In a case where the controller 8 determines in step S8 that the roll sheet RP is present, the controller 8 executes the cutting operation again in step S13. Further, in a case where the controller 8 determines that the roll sheet RP is present in step S17, the controller 8 executes the cutting operation again in step S19. This feature allows for the roll sheet RP to be cut again. Furthermore, the (second) cutting operation in step S13 and the (third) cutting operation in step S19 can be executed at a comparatively early timing. Therefore, this can reduce an amount by which the roll sheet RP is wastefully consumed (a length of the blank).

In a case where the controller 8 determines in step S22 that the roll sheet RP is present, the controller 8 executes the fifth reporting process in step S23. With this, the user easily grasps that the user is to exchange the cutting part 5.

In the above-described embodiment, the determination in each of step S8, step S17 and step S22 is performed based on the output signal from the sheet detecting sensor 10. In a case where the cutting operation is performed in each of the cutting processes and the cutter sensor 16 detects that the carriage 54 is not returned to the standby position, the controller 8 may determine that the roll sheet RP is not cut normally, namely, that the roll sheet RP is present. In a case where the cutting operation is performed in each of the cutting processes and the cutter sensor 16 detects that the carriage 54 is returned to the standby position, the controller 8 may determine that the roll sheet RP is cut normally, namely, that the roll sheet RP is not present. Namely, the cutter sensor 16 may be the "signal outputting part" of the present disclosure. Also in such a modification, even in a case where the roll sheet RP is not cut normally, the image formation is continued and the sixth reporting process in step S26 is performed after the discharging operation of step S24. Such a case can achieve an effect similar to that of the above-described embodiment. Note that in such a case, the sheet detecting sensor 10 may not be provided on the printer 1.

Further, in the above-described embodiment, the image formation is completed after the determination in step S7 is "YES". The image formation may be completed before the determination in step S7 is "YES", depending on a location of the sheet detecting sensor 10 (for example, in a case where the sheet detecting sensor 10 is arranged closely to the head 6). Also in such a case, step S8 is executed after step S7, and the sixth reporting process of step S26 is executed in a case where the determination in step S8 is "YES". Note that the sheet detecting sensor 10 in the present embodiment may be arranged, in the conveying direction, at any position between the head 6 and the cutting part 5.

Further, in the above-described embodiment, step S13 and step S19 may not be executed. In a case where it is determined that the roll sheet RP is present in step S8, steps S10 to S12 are executed. Upon completion of these steps, the procedure proceeds to step S9. Then, after step S9 is executed, steps S24 to S26 are executed. Such a modification can achieve an effect similar to that of the above-described embodiment. Further, in such a case where the procedure proceeds from step S8 to step S9 via step S10 and the image formation is completed in step S9 (step S9: YES), the procedure may proceed from step S9 to step S25. This can prevent the expansion of a blank space upstream of, in the conveying direction, the image area formed by the head 6. Further, it is also allowable that step S54 and step S75 are not executed even in a case where the first cutting process and the second cutting process are executed.

Furthermore, in the above-described embodiment, steps S14 and S20 may not be executed. In such a case, it is allowable to report, in the reporting operation, that an excessive blank is present in the trailing end part of the roll sheet RP.

Moreover, in the above-described embodiment, although the cutting part 5 is disposed upstream of the head 6 in the conveying direction, the cutting part 5 may be disposed downstream of the head 6 in the conveying direction. In a case where the cutting part 5 is disposed downstream of the head 6 in the conveying direction and the controller 8 determines that the roll sheet RP is not cut while a next image is being formed on the roll sheet RP, forming of the next image may be continued without interruption in a similar manner to the above-described embodiment, and then in the reporting process, something to that effect may be reported in the reporting operation in the sixth reporting process. Such a modification can achieve an effect similar to that of the above-described embodiment. Note that in this modification, a sensor, which is configured to detect presence or absence of cutting of the sheet P, may be located downstream of the cutting part 5 in the conveying direction.

Further, in the above-described sixth reporting process, provided that the information indicating that the roll sheet RP is not cut at the cutting scheduled position of the roll sheet RP is reported, further information may not be reported. Moreover, a timing at which the information indicating that the roll sheet RP is not cut at the cutting scheduled position of the roll sheet RP is reported may be a timing after step S8 and before the image formation with respect to the roll sheet RP is completed (before step S9). Further, the first to fifth reporting processes except the sixth reporting process may not be executed.

Furthermore, in the above-described embodiment, in a case where the roll sheet RP is not cut by the cutting operation, the controller 8 causes the reporting part 9 to execute the reporting operation of urging the user that the cover 15 is to be opened and that the roll sheet RP which is exposed from the cover 15 is to be manually cut at the appropriate position. The controller 8, however, may cause the reporting part 9 to urge the user to pull out the forward end of the roll sheet RP frontward from the side of the discharge tray 7, and to cut the roll sheet RP at an appropriate position of the pulled out roll sheet RP. In such a case, the cover 15 may not be provided openable/closable with respect to the casing 11.

Moreover, in the above-described embodiment, step S8 is executed while the image formation based on the roll image forming signal is being executed (namely, before step S9) and after the cutting operation of the first cutting processing of step S5. However, step S8 may be executed after the completion of the image formation. Namely, steps S8 and S10 to S14 may be executed after step S9. Also in such a modification, even in a case where the cutting operation of the first cutting processing is executed while the image formation is being executed, the image formation can be continued without interruption. Owing to this, an effect similar to that of the above-described embodiment can be achieved.

Further, in the above-described embodiment, in the discharging operation, the conveying roller pair 35 is stopped before the trailing end of the roll sheet RP has completely passed the conveying roller pair 35. However, the conveying roller pair 35 may be stopped after the trailing end of the roll sheet RP passes the conveying roller pair 35.

Furthermore, in the above-described embodiment, although the conveyance amount of the sheet P is the same in the two roller pairs 33 and 34, the conveyance amount of the sheet P in the conveying roller pair 33 may be the conveyance amount of the sheet P in the conveying roller pair 34 or more.

The printer in this modification further includes a conveying motor 237M depicted in two-dot-chain-lines in FIG. 2. In this modification, the driving force from the conveying motor 37M is transmitted to the two conveying roller pairs 34 and 35, and the driving force from the conveying motor 237M is transmitted to the conveying roller pair 33. Namely, the controller 8 controls the conveying motor 37M and the conveying motor 237M independently from each other. Therefore, the conveyance amount of the conveying roller pair 33 and the conveyance amount of the conveying roller pair 34 can be set differently from each other.

Further, the flash memory 85 stores values for coefficients K1 and K2 corresponding to respective conditions as indicated in FIG. 8. The coefficient K1 represents multiplier values used in deriving the conveyance amount of the sheet P by the conveying roller pair 33 in the respective conditions. The coefficient K2 represents multiplier values used in deriving the conveyance amount of the sheet P by the conveying roller pair 34 in the respective conditions. The respective conditions include, as depicted in FIG. 8, whether or not the printing to be performed is which one of a roll sheet printing and a cut sheet printing; whether or not the type of paper is plain paper or glossy paper; in the roll sheet printing, whether or not a roll sheet print length (a length from a leading end to a trailing end of the roll sheet RP in a current printing (a printing to be performed this time) is a predetermined amount or less or exceeds the predetermine amount. Note that three or more types of paper may be set. Further, the coefficient regarding the roll sheet print length may be set to three or more.

[Control at the Time of Printing]

Next, a description will be given about the control by the controller 8 at a time of printing of forming an image on the sheet P. In a case where an image forming signal for executing printing is received in the printer 1, the controller 8 performs the processing in accordance with the process in FIGS. 9 to 11. The image forming signal is a signal instructing formation of an image, in the printer 1, on either one of the roll sheet RP and the cut sheet KP, and is transmitted to the controller 8 from the external apparatus. Further, the image forming signal also includes a signal specifying the type of the sheet to be used during the printing. Furthermore, the image forming signal in the roll sheet printing includes a signal indicating a roll sheet print length. Note that the image forming signal in the cut sheet printing includes a signal indicating a size (for example, A4, etc.) of the cut sheet KP.

Figure 9:
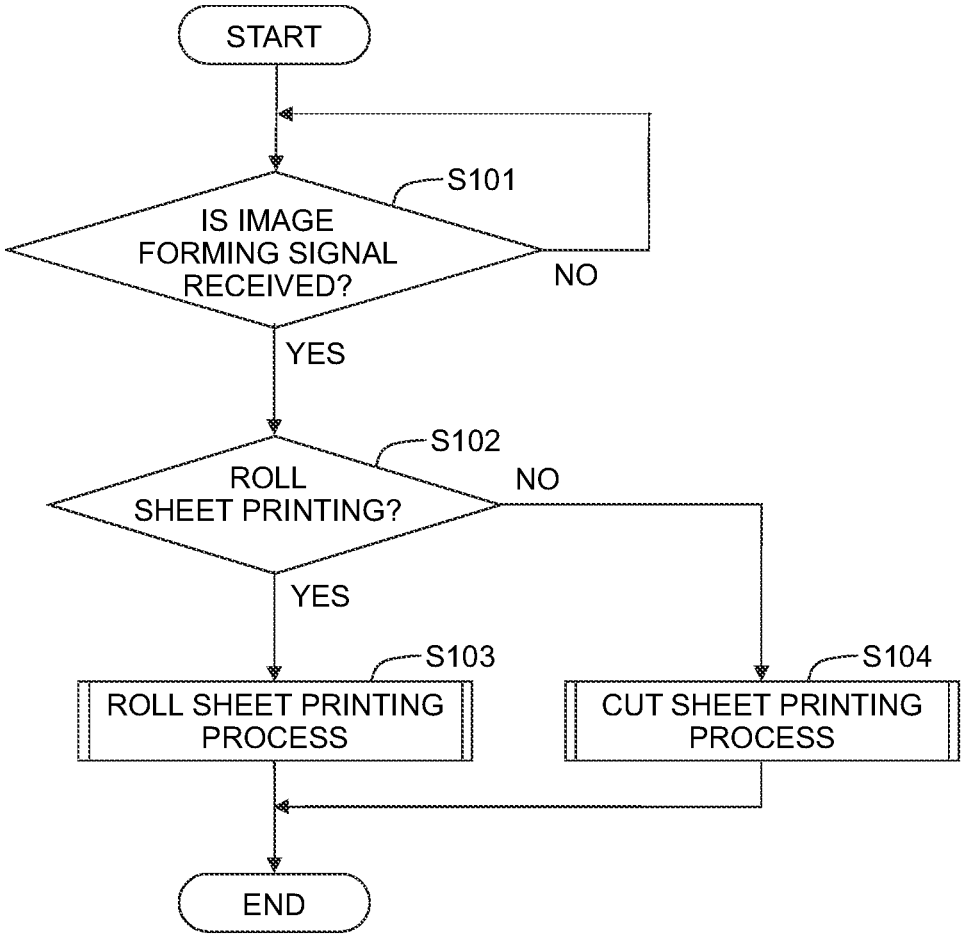
FIG. 9 is a flow chart indicating an example of a process to be executed in a case where the printer according to the modification receives an image forming signal.

To provide a more detailed description regarding the process of FIG. 9, at first, the controller 8 determines whether the image forming signal is received (step S101). In a case where the image forming signal is not received (step S101: NO), the controller 8 repeats step S101. In a case where the image forming signal is received (step S101: YES), the controller 8 determines whether a printing indicated by the image forming signal is the roll sheet printing (step S102).

In a case where the printing is the roll sheet printing (step S102: YES), the controller 8 executes a roll sheet printing processing (step S103). On the other hand, in a case where the printing is not the roll sheet printing (step S102: NO), the controller 8 determines that the printing is the cut sheet printing, and the controller executes a cut sheet printing processing (step S104).

Figure 10A:
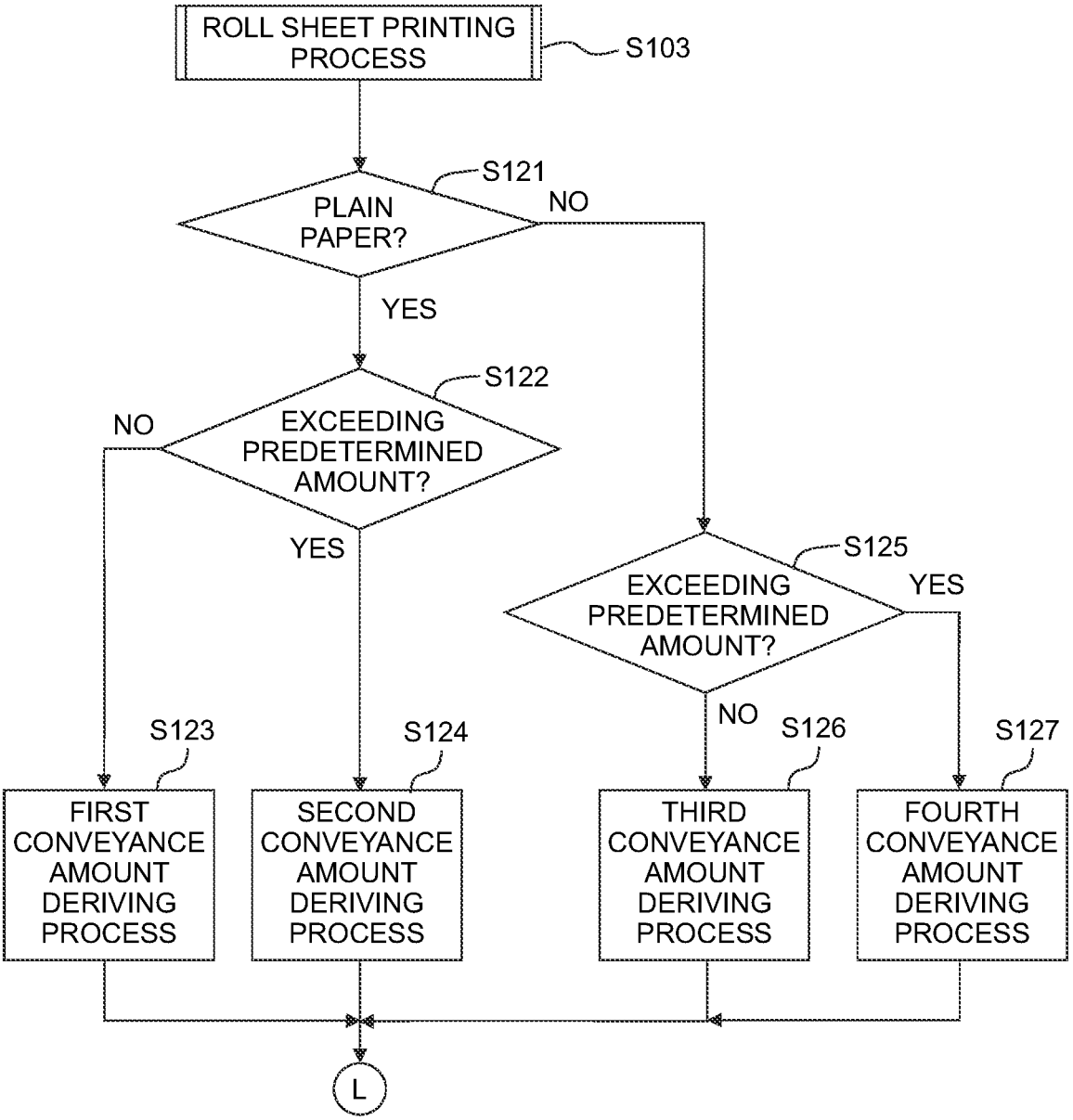
FIGS. 10A and 10B are a flow chart of a roll sheet printing processing indicated in FIG. 9.
Figure 10B:
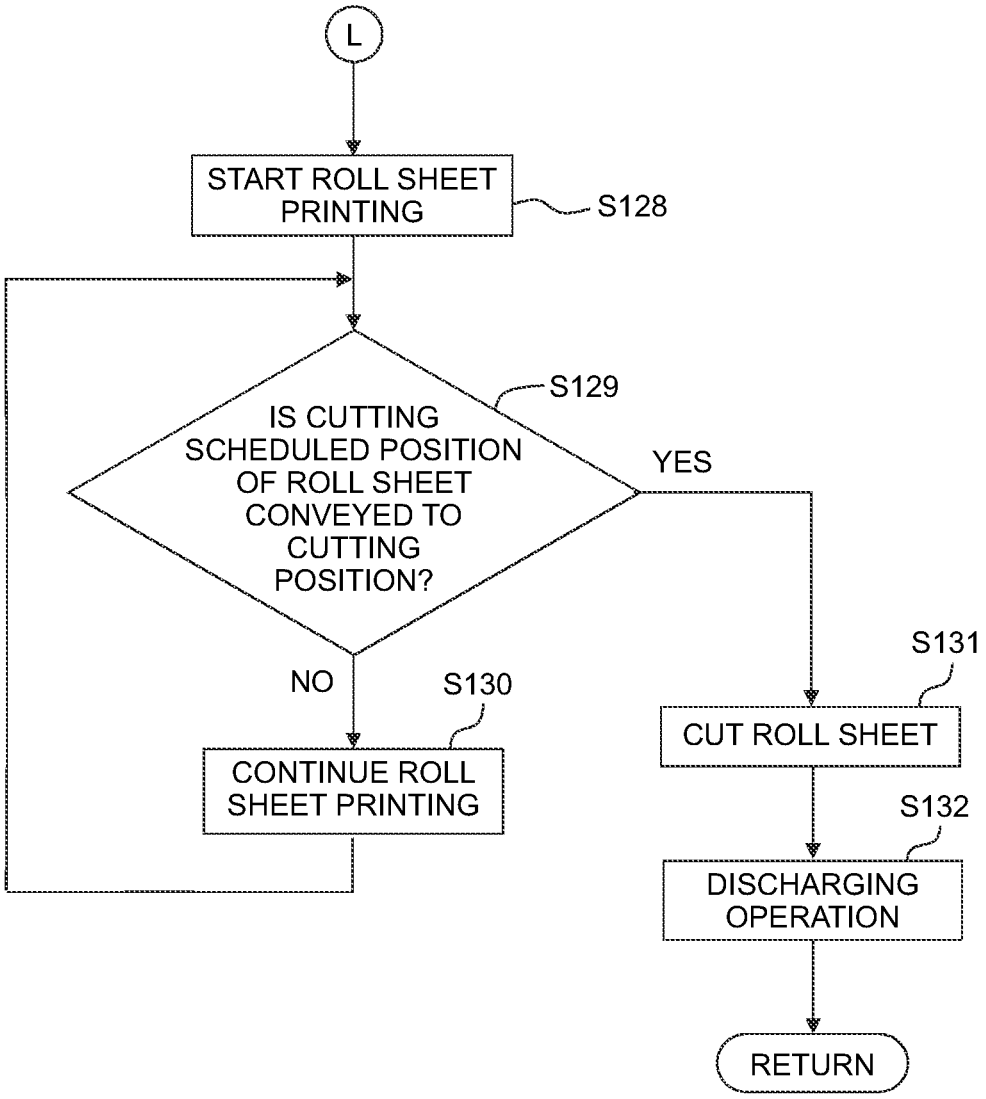

Here, the roll sheet printing processing will be described, with reference to FIGS. 10A and 10B. In the roll sheet printing processing, at first, the controller 8 determines whether the type of paper is plain paper based on the image forming signal (step S121). In a case where the type of paper is plain paper (step S121: YES), the controller 8 determines whether a roll sheet print length based on the image forming signal exceeds a predetermined amount (step S122).

In a case where the roll sheet print length based on the image forming signal is the predetermined amount or less (step S122: NO), the controller 8 executes a first conveyance amount deriving process (step S123). In the first conveyance amount deriving process, the controller 8 derives a conveyance amount of the roll sheet RP by the conveying roller pair 33 and a conveyance amount of the roll sheet RP by the conveying roller pair 34. In the present embodiment, since the two conveying roller pairs 34 and 35 are driven by the same conveying motor 37M, the conveying roller pair 34 and the conveying roller pair 35 have mutually same conveyance amounts. The conveyance amount by the conveying roller pair 33 is derived by multiplying the roll sheet print length by a coefficient K1 (here, 1.1) satisfying the condition. The conveyance amount by the conveying roller pair 34 is derived by multiplying the roll sheet print length by a coefficient K2 (here, 1.0) satisfying the condition.

In such a manner, in the first conveyance amount deriving process, the conveyance amount by the conveying roller pair 33 is greater than the conveyance amount by the conveying roller pair 34 disposed downstream of the conveying roller pair 33 in the conveying direction. Owing to this, the roll sheet RP conveyed by the two conveying roller pairs 33 and 34 is conveyed in such a state that the roll sheet RP is veered outward toward the outer guide 38 with respect to the center between the inner guide 39 and the outer guide 38 between the two conveying roller pairs 33 and 34. Namely, since the roll sheet RP is conveyed along the outer guide 38, an apparent rigidity of the roll sheet RP is increased, thereby stabilizing the conveyance. After step S123, the controller 8 proceeds to step S128.

On the other hand, in a case where the roll sheet print length based on the image forming signal exceeds the predetermined amount (step S122: YES), the controller 8 executes a second conveyance amount deriving process (step S124). Also in the second conveyance amount deriving process, the controller 8 derives the conveyance amount of the roll sheet RP by the conveying roller pair 33 and the conveyance amount of the roll sheet RP by the conveying roller pair 34. The conveyance amount by the conveying roller pair 33 is derived by multiplying the roll sheet print length by a coefficient K1 (here, 1.05) satisfying the condition. The conveyance amount by the conveying roller pair 34 is derived by multiplying the roll sheet print length by a coefficient K2 (here, 1.0) satisfying the condition.

In such a manner, also in the second conveyance amount deriving process, the conveyance amount by the conveying roller pair 33 is greater, to some extent, than the conveyance amount by the conveying roller pair 34 disposed downstream of the conveying roller pair 33 in the conveying direction. Owing to this, the conveyance is stabilized in a similar manner as in the above-described first conveyance amount deriving process. The conveyance amount by the conveying roller pair 33 derived by the second conveyance amount deriving process is smaller than the conveyance amount by the conveying roller pair 33 derived by the first conveyance amount deriving process. In such a manner, in a case where the roll sheet print length exceeds the predetermined amount, the conveyance amount by the conveying roller pair 33 is reduced. This measure can prevent any occurrence of a center folding and/or creasing in the roll sheet RP which tends to occur with a longer roll sheet print length. As a result, any paper jam is less likely to occur. After step S124, the controller 8 proceeds to step S128.

In the present modification, in the case where the roll sheet print length exceeds the predetermined amount, the controller 8 reduces the conveyance amount by the conveying roller pair 33 to be smaller than the conveyance amount by the conveying roller pair 33 in the case where the roll sheet print length is the predetermined amount or less. However, the conveyance amount by the conveying roller pair 33 may be adjusted to be similar to its own conveyance amount in the case where the roll sheet print length is the predetermined amount or less, until the roll sheet RP is conveyed by a predetermined amount. The conveyance amount by the conveying roller pair 33 may be adjusted to be smaller than its own conveyance amount in a case where the roll sheet print length is the predetermined amount or less, after the conveyance of the roll sheet RP exceeds the predetermined amount. Namely, the ratio of the conveyance amount of the roll sheet RP by the conveying roller pair 33 may be changed during the conveyance (namely, after the conveyance of the roll sheet RP by the conveying roller pair 33 exceeds the predetermined amount). In short, as the roll sheet print length becomes longer, the ratio of the conveyance amount by the conveying roller pair 33 may be reduced in a stepped manner. Note that the conveyance amount by the conveying roller pair 33 is equal to or greater than the conveyance amount by the conveying roller pair 34. With this, a similar effect described above can be obtained.

In step S121, in a case where the type of paper is not plain paper (step S121: NO), the controller 8 determines the type of paper is glossy paper and executes a processing step which is similar to that of step S122 as described above (step S125).

In a case where the roll sheet print length is the predetermined amount or less (step S125: NO), the controller 8 executes a third conveyance amount deriving process (step S126). Also in the third conveyance amount deriving process, the controller 8 derives a conveyance amount of the roll sheet RP by the conveying roller pair 33 and a conveyance amount of the roll sheet RP by the conveying roller pair 34. The conveyance amount by the conveying roller pair 33 is derived by multiplying the roll sheet print length by a coefficient K1 (here, 1.15) satisfying the condition. The conveyance amount by the conveying roller pair 34 is derived by multiplying the roll sheet print length by a coefficient K2 (here, 1.05) satisfying the condition.

In such a manner, also in the third conveyance amount deriving process, the conveyance amount by the conveying roller pair 33 is greater, to some extent, than the conveyance amount by the conveying roller pair 34 disposed downstream of the conveying roller pair 33 in the conveying direction. Owing to this, the conveyance is stabilized in a similar manner as in the above-described first conveyance amount deriving process. The conveyance amount by the conveying roller pair 33 and the conveyance amount by the conveying roller pair 34 derived by the third conveyance amount deriving process are respectively greater than those derived by the first conveyance amount deriving process. In such a manner, even in a case where slippage occurs between the roll sheet RP (glossy paper) and the conveying roller pairs 33 and 34, the roll sheet RP can be conveyed with any conveyance loss caused by the slippage being absorbed, by increasing the conveyance amount for the roll sheet RP made of glossy paper beyond the conveyance amount for the roll sheet RP made of plain paper. After step S126, the controller 8 proceeds to step S128.

On the other hand, in a case where the roll sheet print length exceeds the predetermined amount (step S125: YES), the controller 8 executes a fourth conveyance amount deriving process (step S127). Also in the fourth conveyance amount deriving process, the controller 8 derives a conveyance amount of the roll sheet RP by the conveying roller pair 33 and a conveyance amount of the roll sheet RP by the conveying roller pair 34. The conveyance amount by the conveying roller pair 33 is derived by multiplying the roll sheet print length by a coefficient K1 (here, 1.1) satisfying the condition. The conveyance amount by the conveying roller pair 34 is derived by multiplying the roll sheet print length by a coefficient K2 (here, 1.05) satisfying the condition.

In such a manner, also in the fourth conveyance amount deriving process, in a relationship similar to the relationship in each of the second and third conveyance amount deriving processes, an effect similar to that in the second and third conveyance amount deriving processes can be obtained. Namely, the conveyance of the roll sheet RP is stabilized, and the roll sheet RP can be conveyed with any conveyance loss caused by the slippage being absorbed. Further, the roll sheet RP can be prevented from being folded or creased, which tends to occur with a longer roll sheet print length. As a result, any paper jam is less likely to occur. After step S127, the controller 8 proceeds to step S128.

Next, in step S128, the controller 8 starts the roll sheet printing. Namely, the controller 8 conveys, with the conveyor 3, the roll sheet RP from the feed cassette 2 in the conveying direction. Further, the controller 8 forms an image, by the head 6, on the roll sheet RP conveyed by the conveyor 3. In this situation, the controller 8 controls the conveying motors 37M and 237M so that the roll sheet RP is conveyed by the three conveying roller pairs 33 to 35 based on the conveyance amounts derived by the conveyance amount deriving process executed before the roll sheet printing.

Next, the controller 8 determines whether the cutting scheduled position of the roll sheet RP is conveyed so as to reach up to the cutting position of the cutting part 5, in a similar manner to step S3 as described above (step S129). In a case where the roll sheet RP is not conveyed until the cutting scheduled position of the roll sheet RP reaches the cutting position of the cutting part 5 (step S129: NO), the controller 8 continues the roll sheet printing (step S130) and returns to step S129. On the other hand, in a case where the roll sheet RP is conveyed until the cutting scheduled position of the roll sheet RP reaches the cutting position of the cutting part 5 (step S129: YES), the controller 8 stops the conveyance of the roll sheet RP once, and proceeds to step S131.

In step S131, the controller 8 executes the above-described cutting operation, and returns the carriage 54 to the standby position. Afterwards, the controller 8 executes a discharging operation similar to the discharge operation of step S24 (step S132). In such a manner, the process is ended.

Figure 11:
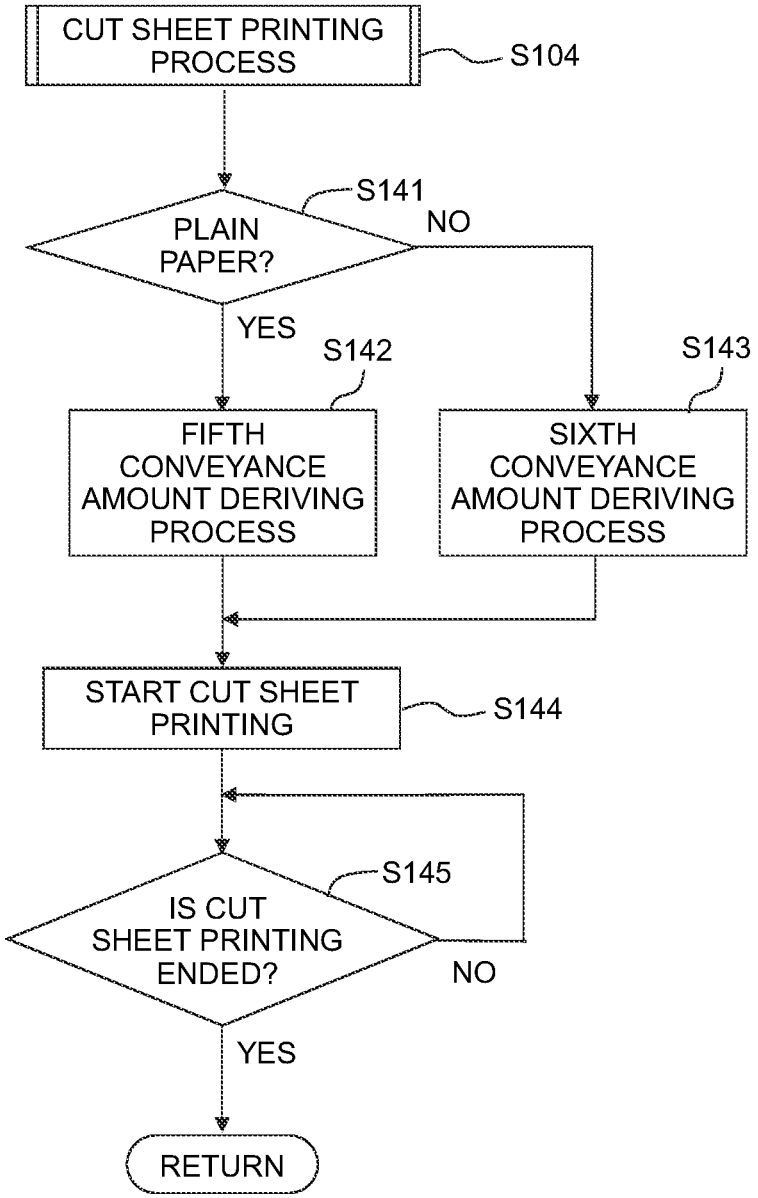
FIG. 11 is a flow chart of a cut sheet printing processing indicated in FIG. 9.

Next, the cut sheet printing processing will be described, with reference to FIG. 11. In the cut sheet printing processing, at first, the controller 8 executes a processing step similar to that of step S121 as described above (step S141). In a case where the type of paper is plain paper (step S141: YES), the controller 8 executes a fifth conveyance amount deriving process (step S142). On the other hand, in a case where the type of paper is not plain paper (step S141: NO), the controller 8 determines the type of paper to be glossy paper, and executes a sixth conveyance amount deriving process (step S143).

Also in the fifth conveyance amount deriving process, the controller 8 derives a conveyance amount of the cut sheet KP by the conveying roller pair 33 and a conveyance amount of the cut sheet KP by the conveying roller pair 34. The conveyance amount of the cut sheet KP by the conveying roller pair 33 is derived by multiplying a sheet size which is to be used this time (for example, a sheet print length of A4 size) by a coefficient K1 (here, 1.1) satisfying the condition. The conveyance amount of the cut sheet KP by the conveying roller pair 34 is derived by multiplying the sheet size which is to be used this time by a coefficient K2 (here, 1.0) satisfying the condition.

In such a manner, also in the fifth conveyance amount deriving process, the conveyance amount by the conveying roller pair 33 is greater than the conveyance amount by the conveying roller pair 34 disposed downstream of the conveying roller pair 33 in the conveying direction. Owing to this, the conveyance is stabilized in a similar manner as in the above-described embodiment. After step S142, the controller 8 proceeds to step S144.

Also in the sixth conveyance amount deriving process, the controller 8 derives a conveyance amount of the cut sheet KP by the conveying roller pair 33 and a conveyance amount of the cut sheet KP by the conveying roller pair 34. The conveyance amount of the cut sheet KP by the conveying roller pair 33 is derived by multiplying a sheet size which is to be used this time (for example, a sheet print length of A4 size) by a coefficient K1 (here, 1.1) satisfying the condition. The conveyance amount of the cut sheet KP by the conveying roller pair 34 is derived by multiplying the sheet size which is to be used this time by a coefficient K2 (here, 1.05) satisfying the condition.

In such a manner, also in the sixth conveyance amount deriving process, the conveyance amount by the conveying roller pair 33 is greater than the conveyance amount by the conveying roller pair 34 disposed downstream of the conveying roller pair 33 in the conveying direction. Owing to this, the conveyance is stabilized in a similar manner as in the above-described embodiment. Although the conveyance amount by the conveying roller pair 33 derived by the sixth conveyance amount deriving process is the same as the conveyance amount by the conveying roller pair 33 derived by the fifth conveyance amount deriving process, the conveyance amount by the conveying roller pair 34 derived by the sixth conveyance amount deriving process is greater than the conveyance amount by the conveying roller pair 34 derived by the fifth conveyance amount deriving process. In such a manner, even in a case where slippage occurs between the cut sheet KP (glossy paper) and the conveying roller pair 34, the cut sheet KP can be conveyed with any conveyance loss caused by the slippage being absorbed, by increasing the conveyance amount for the cut sheet KP made of glossy paper beyond the conveyance amount for the cut sheet KP made of plain paper. Note that since the conveyance amount by the conveyance roller pair 33 is greater than the conveyance amount by the conveying roller pair 34, the conveyance roller pair 33 can convey the cut sheet KP while absorbing the conveyance loss caused by the slippage.

Next, in step S144, the controller 8 starts the cut sheet printing. Namely, the controller 8 conveys, with the conveyor 3, the cut sheet KP from the feed cassette 2 in the conveying direction. Further, the controller 8 forms an image, by the head 6, on the cut sheet KP conveyed by the conveyor 3. In this situation, the controller 8 controls the conveying motors 37M and 237M so that the cut sheet KP is conveyed by the three conveying roller pairs 33 to 35 based on the conveyance amounts derived by the conveyance amount deriving process executed before the cut sheet printing.

Next, the controller 8 determines whether the cut sheet printing based on the image forming signal is ended (step S145). In a case where the cut sheet printing is not ended (step S145: NO), the controller 8 repeats step S145. On the other hand, in a case where the cut sheet printing is ended (step S145: YES), the controller 8 discharges the cut sheet KP on which the image is formed to the discharge tray 7. In such a manner, the process is ended.

In the present modification, values for the coefficients K1 and K2 corresponding to the respective conditions are stored in the flash memory 85. Instead, the flash memory 85 may store unit conveyance amounts in each of the conveying roller pairs 33 and 34 and corresponding to the respective conditions. Alternatively, the flash memory 85 may store the coefficient K1 for deriving the conveyance amount of the conveying roller pair 33, and/or the unit conveyance amounts in the conveying roller pair 33 corresponding to the respective conditions. In such a case, the conveyance amount by the conveying roller pair 34 is smaller than the conveyance amount by the conveying roller pair 33.

As described above, according to the printer of the present modification, since the conveyance amount by the conveying roller pair 33 is greater than the conveyance amount by the conveying roller pair 34 disposed downstream of the conveying roller pair 33 in the conveying direction, the sheet P can be conveyed stably. Owing to this, the sheet P passing through a curved path (a path between the outer guide 38 and the inner guide 39) can be prevented from being slipped or skewed at the conveying roller pair 34. In a case where the conveyance amount by the conveying roller pair 34 is greater than the conveyance amount by the conveying roller pair 33, the sheet P veers toward the inner guide 39 and is conveyed along the inner guide 39. In such a case, although slippage or skewed conveyance of the sheet P is likely to occur between the sheet P and the conveying roller pair 34, the present modification significantly reduces the likelihood of such slippage or skewed conveyance.

Although the embodiment and modification of the present disclosure have been described in the foregoing, the present disclosure is not limited to or restricted by the above-described embodiment and modification, and may be changed in a various manner within the scope of the claims. For example, in the above-descried embodiment, control similar to the roll sheet print control can be performed in cutting the cut sheet KP (for example, in cutting an A3-sized cut sheet into two A4-sized cut sheets and forming an image on each of the two A4-sized cut sheets). Such a case can achieve an effect similar to that of the above-described embodiment.

Further, in the above-described embodiment, the determination is made, in step S54, as to whether the moving velocity is less than the threshold value. However, the determination of step S54 may be made based on as to whether a signal, from the electric current value output circuit connected to the moving motor 53M, indicating the magnitude of load (electric current value) of the moving motor 53M exceeds a threshold value.

Furthermore, in the above-described embodiment, the cutting part 5 has the fixed blade 51. However, the cutting part 5 may have a rotary blade which is movable in the left-right direction together with the rotary blade 52, instead of the fixed blade 51 of the above-described embodiment.

Note that a blade which is not rotatable may be used instead of the rotary blade 52. Moreover, the fixed blade 51 and the rotary blade 52 may be interchanged in the front-rear direction. Namely, the fixed blade 51 may be arranged behind the rotary blade 52.

The present disclosure is also applicable to an electrophotographic printer provided with an image forming part of a laser system in which an electrostatic latent image is formed by exposing a photosensitive body with a laser, or an image forming part of an LED system in which an electrostatic latent image is formed by exposing a photosensitive body with an LED, in addition to being applicable to the ink-jet printer. Further, in the present disclosure, an image forming agent different from the ink can be used. Furthermore, in the present disclosure, the sheet medium is not limited to a paper sheet, and any other medium in sheet form such as cloth (fabric) may be used.

What is claimed is:

1. An image forming apparatus comprising:

a conveyor configured to convey a sheet medium in a conveying direction;

an image forming part configured to form an image on the sheet medium being conveyed by the conveyor;

a cutting part configured to be moved in a direction crossing the conveying direction;

a signal outputting part configured to output a state signal indicating whether or not the sheet medium is cut;

a reporting part; and a controller, wherein the controller is configured to execute:

an image forming process of conveying the sheet medium by the conveyor and forming the image on the sheet medium by the image forming part based on an image forming instruction; and a cutting process of moving the cutting part, and in a case where the sheet medium has not been cut even though the cutting process was executed in the image forming process, the controller is configured to continue the image forming process without interruption and to cause the reporting part to report information regarding a failure of cutting of the sheet medium; and wherein the information includes information indicating that the sheet medium has not been cut.

2. The image forming apparatus according to claim 1, wherein the controller is configured to continue the image formation in the image forming process without interruption even in a case where the controller receives, from the signal outputting part, the state signal indicating that the sheet medium has not been cut after the cutting process and during the image formation on the sheet medium.

3. The image forming apparatus according to claim 1, wherein the controller is configured to cause the reporting part to report the information after completion of the image formation, and the information includes information indicating that the image formation has been continued.

4. An image forming apparatus comprising:

a conveyor configured to convey a sheet medium in a conveying direction;

an image forming part configured to form an image on the sheet medium being conveyed by the conveyor;

a cutting part configured to be moved in a direction crossing the conveying direction;

a signal outputting part configured to output a state signal indicating whether or not the sheet medium is cut;

a reporting part; and a controller, wherein the controller is configured to execute:

an image forming process of conveying the sheet medium by the conveyor and forming the image on the sheet medium by the image forming part based on an image forming instruction; and a cutting process of moving the cutting part, and in a case where the sheet medium has not been cut even though the cutting process was executed in the image forming process, the controller is configured to continue the image forming process without interruption and to cause the reporting part to report information regarding a failure of cutting of the sheet medium; and wherein the information includes information urging cutting of the sheet medium manually.

5. The image forming apparatus according to claim 4, further comprising:

an apparatus body on which the conveyor and the image forming part are mounted; and a cover movable between a closed position and an open position, wherein at the closed position, the cover defines, between the cover and the apparatus body, a conveyance path of the sheet medium downstream of the cutting part in the conveying direction, at the open position, at least a part of the cover is separated from the apparatus body and the conveyance path is thereby exposed to outside, and the information includes information urging opening of the cover and cutting of the sheet medium manually.

6. An image forming apparatus comprising:

a conveyor configured to convey a sheet medium in a conveying direction;

an image forming part configured to form an image on the sheet medium being conveyed by the conveyor;

a cutting part configured to be moved in a direction crossing the conveying direction;

a signal outputting part configured to output a state signal indicating whether or not the sheet medium is cut;

a reporting part; and a controller, wherein the controller is configured to execute:

an image forming process of conveying the sheet medium by the conveyor and forming the image on the sheet medium by the image forming part based on an image forming instruction; and a cutting process of moving the cutting part, and in a case where the sheet medium has not been cut even though the cutting process was executed in the image forming process, the controller is configured to continue the image forming process without interruption and to cause the reporting part to report information regarding a failure of cutting of the sheet medium; and wherein the cutting part is disposed upstream of the image forming part in the conveying direction.

7. The image forming apparatus according to claim 6, wherein the signal outputting part is a sensor configured to output, as the state signal, a signal indicating presence or absence of the sheet medium at a predetermined position between the cutting part and the image forming part in a conveyance path of the sheet medium, and the controller is configured to stop conveyance of the sheet medium by the conveyor in a case where the controller does not receive, from the sensor, the state signal indicating the absence of the sheet medium at the predetermined position until a first time elapses since the cutting process has been executed.

8. The image forming apparatus according to claim 6, wherein the signal outputting part is a sensor configured to output, as the state signal, a signal indicating presence or absence of the sheet medium at a predetermined position between the cutting part and the image forming part in a conveyance path of the sheet medium, and the controller is configured to determine that the sheet medium has not been cut by the cutting process in a case where the controller does not receive, from the sensor, the state signal indicating the absence of the sheet medium at the predetermined position until a first time elapses since the cutting process has been executed.

9. The image forming apparatus according to claim 6, wherein the conveyor includes a plurality of roller pairs disposed along the conveying direction, and in a case where the sheet medium has been cut by the cutting process, the controller is configured to stop conveyance of the sheet medium by the conveyor before a trailing end of the sheet medium completely passes a roller pair, which is a most downstream roller pair, of the roller pairs.

10. An image forming apparatus comprising:

a conveyor configured to convey a sheet medium in a conveying direction;

an image forming part configured to form an image on the sheet medium being conveyed by the conveyor;

a cutting part configured to be moved in a direction crossing the conveying direction;

a signal outputting part configured to output a state signal indicating whether or not the sheet medium is cut;

a reporting part; and a controller, wherein the controller is configured to execute:

an image forming process of conveying the sheet medium by the conveyor and forming the image on the sheet medium by the image forming part based on an image forming instruction; and a cutting process of moving the cutting part, and in a case where the sheet medium has not been cut even though the cutting process was executed in the image forming process, the controller is configured to continue the image forming process without interruption and to cause the reporting part to report information regarding a failure of cutting of the sheet medium; and wherein in a case where the sheet medium has not been cut, the controller is configured to execute the cutting process again.

11. The image forming apparatus according to claim 10, wherein in a case where the sheet medium has been cut by executing the cutting process again, the controller is configured to cause the reporting part to report information indicating that an excessive blank is present in a trailing end part of the sheet medium.

12. The image forming apparatus according to claim 10, wherein in a case where the sheet medium has been cut by executing the cutting process again, the controller is configured to cause the reporting part to report information urging cutting of a blank in a trailing end part of the sheet medium manually.

13. The image forming apparatus according to claim 10, wherein in a case where the sheet medium has not been cut even by executing the cutting process again, the controller is configured to cause the reporting part to report information urging an exchange of the cutting part.

14. The image forming apparatus according to claim 10, wherein the controller is configured to store the number of executions of the cutting process and to further execute a deriving process of deriving a surplus length from a cutting scheduled position, of the sheet medium, based on the number of executions, and in a case where the sheet medium has been cut by executing the cutting process again, the controller is configured to cause the reporting part to reporting information indicating that a blank of the surplus length derived by the deriving process is present in a trailing end part of the sheet medium.

15. An image forming apparatus, comprising:

a conveyor configured to convey a sheet medium in a conveying direction;

an image forming part configured to form an image on the sheet medium being conveyed by the conveyor;

a cutting part disposed upstream of the image forming part in the conveying direction and configured to be moved in a direction crossing the conveying direction;

a reporting part; and a controller, wherein the controller is configured to execute:

an image forming process of conveying the sheet medium by the conveyor and forming the image on the sheet medium by the image forming part based on an image forming instruction; and a cutting process of moving the cutting part, and in a case where the sheet medium has not been cut even though the cutting process was executed in the image forming process, the controller is configured to continue the image forming process without interruption and to cause the reporting part to report information regarding a failure of cutting of the sheet medium.

16. An image forming method executable by an image forming apparatus, the image forming apparatus including: a conveyor configured to convey a sheet medium in a conveying direction; an image forming part configured to form an image on the sheet medium being conveyed by the conveyor; a cutting part disposed upstream of the image forming part in the conveying direction and configured to be moved in a direction crossing the conveying direction; and a reporting part, the method comprising:

an image forming process of conveying the sheet medium by the conveyor and forming the image on the sheet medium by the image forming part based on an image forming instruction; and a cutting process of moving the cutting part, wherein in a case where the sheet medium has not been cut even though the cutting process was executed in the image forming process, the image forming process is continued without interruption and information regarding a failure of cutting of the sheet medium is reported by the reporting part.

* * * * *